US008500538B2

(12) United States Patent
Warner et al.

(10) Patent No.: US 8,500,538 B2
(45) Date of Patent: Aug. 6, 2013

(54) BINGO GAMING SYSTEM AND METHOD FOR PROVIDING MULTIPLE OUTCOMES FROM SINGLE BINGO PATTERN

(75) Inventors: Jeremy J. Warner, Reno, NV (US); Justin M. Krum, Reno, NV (US); Tracy L. Powell, Reno, NV (US)

(73) Assignee: IGT, Reno, NV (US)

( * ) Notice: Subject to any disclaimer, the term of this patent is extended or adjusted under 35 U.S.C. 154(b) by 548 days.

(21) Appl. No.: 12/512,561

(22) Filed: Jul. 30, 2009

(65) Prior Publication Data

US 2011/0028201 A1 Feb. 3, 2011

(51) Int. Cl.
*A63F 3/06* (2006.01)

(52) U.S. Cl.
USPC ..... 463/19; 463/20; 463/25; 463/27

(58) Field of Classification Search
USPC ..... 273/269, 270; 463/17–19, 25–28, 463/40–42, 20
See application file for complete search history.

(56) References Cited

U.S. PATENT DOCUMENTS

| | | | | |
|---|---|---|---|---|
| 4,218,063 | A | 8/1980 | Cooper et al. | |
| 4,427,198 | A | 1/1984 | Larue | |
| 4,624,462 | A | 11/1986 | Itkis | |
| 4,651,995 | A | 3/1987 | Henkel | |
| 4,856,787 | A | 8/1989 | Itkis | |
| 4,875,686 | A | 10/1989 | Timms | |
| 5,042,809 | A * | 8/1991 | Richardson | 463/18 |
| 5,160,146 | A | 11/1992 | Greer | |
| 5,265,880 | A | 11/1993 | Maksymec | |
| 5,275,400 | A | 1/1994 | Weingardt et al. | |
| 5,297,802 | A | 3/1994 | Pocock et al. | |
| 5,324,035 | A * | 6/1994 | Morris et al. | 463/42 |
| 5,338,042 | A | 8/1994 | Greer | |
| 5,351,970 | A | 10/1994 | Fioretti | |
| 5,393,057 | A * | 2/1995 | Marnell, II | 463/13 |
| 5,467,996 | A | 11/1995 | Greer | |
| 5,482,289 | A * | 1/1996 | Weingardt | 273/269 |

(Continued)

FOREIGN PATENT DOCUMENTS

| | | |
|---|---|---|
| EP | 0 702 987 | 3/1996 |
| EP | 1 818 883 | 8/2007 |

(Continued)

OTHER PUBLICATIONS

"Scarne's Encyclopedia of Gambling," by John Scarne, 1961, Simon & Schuster, chapter on bingo.*

(Continued)

*Primary Examiner* — David L Lewis
*Assistant Examiner* — Matthew D Hoel
(74) *Attorney, Agent, or Firm* — Neal, Gerber & Eisenberg LLP

(57) ABSTRACT

The gaming system and method disclosed herein provides a bingo game wherein a single bingo pattern is associated with a plurality of outcomes. In one such embodiment, a first bingo pattern is associated with a static outcome, such as an award of a designated value, and a second bingo pattern is associated with an open-ended outcome, such as a progressive award. If a bingo pattern associated with a progressive award is covered, the disclosed gaming system and method causes the bingo game to display a symbol combination associated with the progressive award. In one embodiment, the disclosed gaming system and method selects the symbol combination from a plurality of symbol combinations associated with the progressive award.

18 Claims, 9 Drawing Sheets

U.S. PATENT DOCUMENTS

| | | | | |
|---|---|---|---|---|
| 5,518,253 | A | 5/1996 | Pocock et al. | |
| 5,569,083 | A | 10/1996 | Fioretti | |
| 5,577,971 | A | 11/1996 | File | |
| 5,647,798 | A * | 7/1997 | Falciglia | 463/19 |
| 5,673,916 | A | 10/1997 | Horan | |
| 5,679,077 | A | 10/1997 | Pocock et al. | |
| 5,718,631 | A | 2/1998 | Invencion | |
| 5,727,786 | A | 3/1998 | Weingardt et al. | |
| 5,755,619 | A | 5/1998 | Matsumoto et al. | |
| 5,823,534 | A | 10/1998 | Banyai | |
| 5,830,067 | A | 11/1998 | Graves et al. | |
| 5,857,911 | A | 1/1999 | Fioretti | |
| 5,954,582 | A * | 9/1999 | Zach | 463/25 |
| 5,967,895 | A * | 10/1999 | Kellen | 463/19 |
| 6,077,162 | A * | 6/2000 | Weiss | 463/26 |
| 6,089,980 | A | 7/2000 | Gauselmann | |
| 6,099,407 | A | 8/2000 | Parker, Jr. et al. | |
| 6,120,024 | A | 9/2000 | Lind | |
| 6,132,312 | A * | 10/2000 | Hecht | 463/19 |
| 6,186,892 | B1 | 2/2001 | Frank et al. | |
| 6,203,428 | B1 | 3/2001 | Giobbi et al. | |
| 6,220,596 | B1 | 4/2001 | Horan | |
| 6,241,608 | B1 | 6/2001 | Torango | |
| 6,280,325 | B1 | 8/2001 | Fisk | |
| 6,398,645 | B1 * | 6/2002 | Yoseloff | 463/19 |
| 6,409,173 | B1 | 6/2002 | Tri | |
| 6,435,968 | B1 | 8/2002 | Torango | |
| 6,461,241 | B1 * | 10/2002 | Webb et al. | 463/20 |
| 6,482,088 | B2 | 11/2002 | Santini, Jr. | |
| 6,502,116 | B1 * | 12/2002 | Kelly et al. | 708/250 |
| 6,524,185 | B2 | 2/2003 | Lind | |
| 6,565,091 | B2 | 5/2003 | Weingardt | |
| 6,569,017 | B2 | 5/2003 | Enzminger et al. | |
| 6,581,935 | B1 | 6/2003 | Odom | |
| 6,582,305 | B1 | 6/2003 | Carter | |
| 6,592,460 | B2 | 7/2003 | Torango | |
| 6,599,188 | B2 | 7/2003 | Hirsch et al. | |
| 6,599,193 | B2 | 7/2003 | Baerlocher et al. | |
| 6,607,440 | B2 | 8/2003 | Santini, Jr. | |
| 6,616,531 | B1 | 9/2003 | Mullins | |
| 6,645,072 | B1 | 11/2003 | Kellen | |
| 6,656,044 | B1 | 12/2003 | Lewis | |
| 6,666,767 | B1 | 12/2003 | Dayan | |
| 6,699,122 | B1 * | 3/2004 | Osawa | 463/20 |
| 6,722,655 | B1 | 4/2004 | Camero | |
| 6,729,959 | B1 | 5/2004 | Moore et al. | |
| 6,743,102 | B1 | 6/2004 | Fiechter et al. | |
| 6,755,738 | B2 | 6/2004 | Glasson et al. | |
| 6,755,739 | B2 | 6/2004 | Santini, Jr. | |
| 6,758,748 | B2 | 7/2004 | Byrne | |
| 6,764,398 | B2 * | 7/2004 | Stone et al. | 463/25 |
| 6,780,108 | B1 | 8/2004 | Luciano, Jr. et al. | |
| 6,793,219 | B2 | 9/2004 | Higginson | |
| 6,802,776 | B2 | 10/2004 | Lind et al. | |
| 6,832,956 | B1 | 12/2004 | Boyd et al. | |
| 6,835,138 | B2 | 12/2004 | Baeg | |
| 6,857,958 | B2 * | 2/2005 | Osawa | 463/20 |
| 6,899,622 | B2 | 5/2005 | Lind et al. | |
| 6,921,334 | B1 | 7/2005 | Bennett | |
| 6,929,546 | B2 | 8/2005 | Moore | |
| 6,955,604 | B1 | 10/2005 | Graves | |
| 6,969,320 | B2 | 11/2005 | Lind et al. | |
| 7,037,193 | B1 | 5/2006 | Kasparov et al. | |
| 7,056,212 | B2 | 6/2006 | Boyd et al. | |
| 7,059,966 | B2 | 6/2006 | Luciano, Jr. et al. | |
| 7,066,812 | B2 | 6/2006 | Fried et al. | |
| 7,077,746 | B2 | 7/2006 | Torango | |
| 7,097,561 | B2 | 8/2006 | Lark | |
| 7,118,477 | B1 | 10/2006 | Kellen | |
| 7,134,959 | B2 | 11/2006 | Penrice | |
| 7,175,525 | B2 | 2/2007 | Lind | |
| 7,213,811 | B2 | 5/2007 | Bozeman | |
| 7,278,918 | B2 | 10/2007 | Lind | |
| 7,306,519 | B2 | 12/2007 | Baerlocher | |
| 7,314,411 | B2 | 1/2008 | Lannert et al. | |
| 7,316,612 | B2 | 1/2008 | Odom | |
| 7,322,886 | B2 | 1/2008 | Manz | |
| 7,338,368 | B2 | 3/2008 | Lind et al. | |
| 7,351,140 | B2 | 4/2008 | Wolf et al. | |
| 7,357,716 | B2 | 4/2008 | Marks et al. | |
| 7,364,510 | B2 | 4/2008 | Walker et al. | |
| 7,387,571 | B2 | 6/2008 | Walker et al. | |
| 7,393,280 | B2 | 7/2008 | Cannon | |
| 7,399,227 | B2 | 7/2008 | Michaelson et al. | |
| 7,470,186 | B2 | 12/2008 | Cannon | |
| 7,473,172 | B2 | 1/2009 | DeLozier | |
| 7,476,155 | B2 | 1/2009 | Lind et al. | |
| 7,481,431 | B2 | 1/2009 | Miller et al. | |
| 7,481,707 | B1 | 1/2009 | Luciano, Jr. et al. | |
| 7,500,912 | B2 | 3/2009 | Owen | |
| 7,500,915 | B2 | 3/2009 | Wolf et al. | |
| 7,510,473 | B2 | 3/2009 | Thomas | |
| 7,537,520 | B2 | 5/2009 | Campo et al. | |
| 2001/0031660 | A1 | 10/2001 | Wilk et al. | |
| 2002/0045472 | A1 * | 4/2002 | Adams | 463/19 |
| 2002/0052231 | A1 | 5/2002 | Fioretti | |
| 2002/0094860 | A1 | 7/2002 | Itkis et al. | |
| 2002/0113369 | A1 | 8/2002 | Weingardt | |
| 2002/0132661 | A1 | 9/2002 | Lind et al. | |
| 2003/0038422 | A1 | 2/2003 | Mattice et al. | |
| 2003/0040354 | A1 | 2/2003 | Itkis et al. | |
| 2003/0045341 | A1 | 3/2003 | Itkis et al. | |
| 2003/0045342 | A1 | 3/2003 | Miller et al. | |
| 2003/0045350 | A1 * | 3/2003 | Baerlocher et al. | 463/25 |
| 2003/0104865 | A1 | 6/2003 | Itkis et al. | |
| 2003/0137143 | A1 | 7/2003 | Itkis et al. | |
| 2003/0144050 | A1 | 7/2003 | Keaton et al. | |
| 2003/0148808 | A1 | 8/2003 | Price | |
| 2003/0162594 | A1 | 8/2003 | Rowe | |
| 2003/0171986 | A1 | 9/2003 | Itkis et al. | |
| 2003/0176214 | A1 | 9/2003 | Burak et al. | |
| 2003/0178771 | A1 | 9/2003 | Banyai | |
| 2003/0186736 | A1 | 10/2003 | Benbrahim | |
| 2003/0195032 | A1 | 10/2003 | Enzminger et al. | |
| 2003/0203750 | A1 | 10/2003 | Falciglia | |
| 2003/0216166 | A1 | 11/2003 | Baerlocher et al. | |
| 2003/0224847 | A1 | 12/2003 | Jaimet | |
| 2004/0048644 | A1 | 3/2004 | Gerrard et al. | |
| 2004/0048647 | A1 | 3/2004 | Lind et al. | |
| 2004/0063489 | A1 | 4/2004 | Crumby | |
| 2004/0063491 | A1 | 4/2004 | Banyai et al. | |
| 2004/0072604 | A1 | 4/2004 | Toyoda | |
| 2004/0072605 | A1 | 4/2004 | Toyoda | |
| 2004/0121834 | A1 | 6/2004 | Libby et al. | |
| 2004/0130096 | A1 | 7/2004 | Duhamel | |
| 2004/0152499 | A1 | 8/2004 | Lind et al. | |
| 2004/0152503 | A1 | 8/2004 | Lind et al. | |
| 2004/0152508 | A1 | 8/2004 | Lind et al. | |
| 2004/0176169 | A1 | 9/2004 | Lind et al. | |
| 2004/0178579 | A1 | 9/2004 | Lowell et al. | |
| 2004/0214626 | A1 | 10/2004 | Lind et al. | |
| 2004/0224770 | A1 | 11/2004 | Wolf et al. | |
| 2004/0229693 | A1 | 11/2004 | Lind et al. | |
| 2004/0229698 | A1 | 11/2004 | Lind et al. | |
| 2004/0242322 | A1 | 12/2004 | Montagna et al. | |
| 2004/0251628 | A1 | 12/2004 | Kilby | |
| 2005/0026669 | A1 | 2/2005 | Nelson et al. | |
| 2005/0043079 | A1 | 2/2005 | Huang | |
| 2005/0054427 | A1 | 3/2005 | Toyoda | |
| 2005/0059449 | A1 | 3/2005 | Yarbrough | |
| 2005/0059458 | A1 | 3/2005 | Griswold et al. | |
| 2005/0059467 | A1 | 3/2005 | Saffari et al. | |
| 2005/0059468 | A1 | 3/2005 | Cannon | |
| 2005/0059469 | A1 | 3/2005 | Gail et al. | |
| 2005/0059470 | A1 * | 3/2005 | Cannon | 463/19 |
| 2005/0059471 | A1 | 3/2005 | Cannon | |
| 2005/0064932 | A1 | 3/2005 | Cannon | |
| 2005/0075161 | A1 | 4/2005 | Mcglone et al. | |
| 2005/0093240 | A1 | 5/2005 | Jones et al. | |
| 2005/0096119 | A1 | 5/2005 | Lind et al. | |
| 2005/0096130 | A1 | 5/2005 | Mullins | |
| 2005/0101370 | A1 | 5/2005 | Lind et al. | |
| 2005/0101387 | A1 | 5/2005 | Wolf | |
| 2005/0107163 | A1 | 5/2005 | Nguyen et al. | |
| 2005/0119042 | A1 * | 6/2005 | Chamberlain et al. | 463/19 |
| 2005/0130730 | A1 | 6/2005 | Lind et al. | |
| 2005/0137016 | A1 | 6/2005 | Enzminger et al. | |

2005/0143168 A1 6/2005 Torango
2005/0148382 A1 7/2005 Fox
2005/0156428 A1 7/2005 Lind et al.
2005/0164771 A1 7/2005 Lind et al.
2005/0164772 A1 7/2005 Lind et al.
2005/0164773 A1 7/2005 Lind et al.
2005/0167916 A1 8/2005 Banyai
2005/0176491 A1 8/2005 Kane et al.
2005/0187014 A1 8/2005 Saffari et al.
2005/0192088 A1 9/2005 Hartman et al.
2005/0221883 A1 10/2005 Lind et al.
2005/0233798 A1 10/2005 Van Asdale
2005/0239543 A1 10/2005 Enzminger et al.
2005/0250572 A1 11/2005 Kane et al.
2005/0255906 A1 11/2005 Lind et al.
2005/0261046 A1 11/2005 Griswold et al.
2005/0261050 A1* 11/2005 Waters ..... 463/19
2005/0272499 A1 12/2005 Lind et al.
2006/0009282 A1 1/2006 George et al.
2006/0014582 A1 1/2006 Harris et al.
2006/0014583 A1 1/2006 Harris et al.
2006/0019735 A1 1/2006 Toyoda
2006/0025189 A1 2/2006 Hollibaugh et al.
2006/0025193 A1 2/2006 Gail et al.
2006/0025195 A1 2/2006 Pennington et al.
2006/0025198 A1 2/2006 Gail et al.
2006/0025199 A1 2/2006 Harkins et al.
2006/0030403 A1 2/2006 Lafky et al.
2006/0035700 A1 2/2006 Van Asdale
2006/0040717 A1 2/2006 Lind et al.
2006/0040727 A1 2/2006 Lind et al.
2006/0046817 A1 3/2006 Paulsen et al.
2006/0052148 A1 3/2006 Blair et al.
2006/0052160 A1 3/2006 Saffari et al.
2006/0058096 A1 3/2006 Lind et al.
2006/0060290 A1 3/2006 Jarck
2006/0063578 A1 3/2006 Bansemer et al.
2006/0068880 A1 3/2006 Cannon
2006/0094509 A1 5/2006 Michaelson et al.
2006/0111168 A1 5/2006 Nguyen et al.
2006/0121976 A1 6/2006 Odom
2006/0121977 A1 6/2006 Odom
2006/0135241 A1 6/2006 Wolf et al.
2006/0154714 A1 7/2006 Montross et al.
2006/0154723 A1* 7/2006 Saffari et al. ..... 463/29
2006/0160598 A1 7/2006 Wells et al.
2006/0160603 A1 7/2006 Lulek
2006/0163806 A1 7/2006 Toyoda
2006/0172791 A1 8/2006 Wolf
2006/0172799 A1 8/2006 Kane et al.
2006/0178186 A1 8/2006 Lind
2006/0183535 A1 8/2006 Marks et al.
2006/0205468 A1 9/2006 Saffari et al.
2006/0205477 A1 9/2006 Fisk et al.
2006/0205478 A1 9/2006 Padgett
2006/0211483 A1 9/2006 Padgett
2006/0211496 A1 9/2006 Manz
2006/0211497 A1 9/2006 Manz
2006/0252493 A1 11/2006 Tribout, Jr.
2006/0287057 A1 12/2006 Osawa
2006/0287058 A1 12/2006 Resnick et al.
2007/0004496 A1 1/2007 Gordon et al.
2007/0010319 A1 1/2007 Lind et al.
2007/0032285 A1 2/2007 Wolf
2007/0043584 A1* 2/2007 Waters ..... 463/19
2007/0054733 A1 3/2007 Baerlocher
2007/0060271 A1 3/2007 Cregan et al.
2007/0060288 A1 3/2007 Willyard et al.
2007/0060314 A1 3/2007 Baerlocher et al.
2007/0060321 A1 3/2007 Vasquez et al.
2007/0060341 A1 3/2007 Lind
2007/0093285 A1 4/2007 Lee
2007/0105615 A1 5/2007 Lind
2007/0117608 A1 5/2007 Roper et al.
2007/0123329 A1 5/2007 Frank et al.
2007/0135205 A1 6/2007 Houle et al.
2007/0155471 A1 7/2007 Powell et al.
2007/0155472 A1 7/2007 Gail et al.
2007/0155473 A1 7/2007 Powell et al.
2007/0155480 A1 7/2007 Brosnan et al.
2007/0161423 A1 7/2007 Bienvenue et al.
2007/0167210 A1 7/2007 Kelly et al.
2007/0167216 A1 7/2007 Walker et al.
2007/0184887 A1 8/2007 Cannon
2007/0191088 A1 8/2007 Breckner et al.
2007/0218975 A1 9/2007 Iddings et al.
2007/0218982 A1 9/2007 Baerlocher
2007/0257430 A1 11/2007 Hardy et al.
2007/0265058 A1 11/2007 Govender et al.
2007/0284821 A1 12/2007 Hall
2007/0293294 A1 12/2007 Lind et al.
2007/0293302 A1 12/2007 Lind et al.
2007/0298874 A1 12/2007 Baerlocher et al.
2007/0298875 A1 12/2007 Baerlocher et al.
2008/0020832 A1 1/2008 Iddings et al.
2008/0020833 A1 1/2008 Baerlocher et al.
2008/0020834 A1 1/2008 Breckner et al.
2008/0020846 A1 1/2008 Vasquez et al.
2008/0026813 A1 1/2008 Cannon
2008/0026837 A1 1/2008 Lind
2008/0039191 A1 2/2008 Cuddy
2008/0045301 A1 2/2008 Lind et al.
2008/0051169 A1 2/2008 Michaelson et al.
2008/0058058 A1 3/2008 Lind et al.
2008/0058093 A1 3/2008 Lind et al.
2008/0076510 A1 3/2008 Ito et al.
2008/0076514 A1 3/2008 Baerlocher et al.
2008/0076515 A1 3/2008 Baerlocher et al.
2008/0076517 A1 3/2008 Baerlocher et al.
2008/0076552 A1 3/2008 Baerlocher et al.
2008/0090634 A1 4/2008 Baerlocher
2008/0090651 A1 4/2008 Baerlocher
2008/0096669 A1 4/2008 Lind et al.
2008/0102944 A1 5/2008 Lannert et al.
2008/0108410 A1 5/2008 Baerlocher
2008/0108423 A1 5/2008 Benbrahim et al.
2008/0108430 A1 5/2008 Evans
2008/0108431 A1 5/2008 Cuddy et al.
2008/0113734 A1 5/2008 Watkins et al.
2008/0113763 A1 5/2008 Michaelson et al.
2008/0113779 A1 5/2008 Cregan
2008/0125208 A1 5/2008 Waters
2008/0153568 A1 6/2008 Lind et al.
2008/0176650 A1 7/2008 Wolf et al.
2008/0182641 A1 7/2008 Malone et al.
2008/0188279 A1 8/2008 Seelig et al.
2008/0207302 A1 8/2008 Lind et al.
2008/0224400 A1 9/2008 Gnat
2008/0234036 A1 9/2008 Reddicks et al.
2008/0248863 A1 10/2008 Seymour et al.
2008/0254854 A1 10/2008 Slomiany et al.
2008/0277871 A1 11/2008 Saheki
2008/0293475 A1 11/2008 Toyoda
2008/0300040 A1 12/2008 Goto et al.
2009/0005147 A1 1/2009 Okuaki et al.
2009/0011814 A1 1/2009 Lozano et al.
2009/0017895 A1 1/2009 Harris
2009/0036194 A1 2/2009 Naicker et al.
2009/0042645 A1 2/2009 Graham et al.
2009/0054125 A1 2/2009 Toyoda
2009/0061979 A1 3/2009 Okuaki et al.
2009/0061981 A1 3/2009 Smith
2009/0075713 A1 3/2009 Hartman et al.
2009/0075714 A1 3/2009 Meyer et al.
2009/0075715 A1 3/2009 Coleman et al.
2009/0088244 A1 4/2009 Nicely et al.
2009/0111560 A1 4/2009 Davis et al.
2009/0111561 A1 4/2009 Dewaal et al.
2009/0121430 A1 5/2009 Ito
2009/0124362 A1 5/2009 Cuddy et al.
2009/0124363 A1 5/2009 Baerlocher et al.
2009/0124364 A1 5/2009 Cuddy et al.
2009/0137305 A1 5/2009 Luciano, Jr. et al.
2009/0143129 A1 6/2009 Bailey et al.
2009/0143130 A1 6/2009 Lind et al.
2009/0156296 A1 6/2009 Manz
2009/0179380 A1 7/2009 Hall
2009/0191956 A1 7/2009 Lyons et al.

FOREIGN PATENT DOCUMENTS

| | | |
|---|---|---|
| EP | 1 955 743 | 8/2008 |
| EP | 1 955 744 | 8/2008 |
| EP | 1 965 360 | 9/2008 |
| EP | 1 990 076 | 11/2008 |
| WO | WO 95/19207 | 7/1995 |
| WO | WO 01/52956 | 7/2001 |
| WO | WO 02/060547 | 8/2002 |
| WO | WO 2005/045609 | 5/2005 |
| WO | WO 2005/114459 | 12/2005 |
| WO | WO 2007/033200 | 3/2007 |
| WO | WO 2007/049115 | 5/2007 |
| WO | WO 2007/081310 | 7/2007 |
| WO | WO 2008/060062 | 5/2008 |

OTHER PUBLICATIONS

Big Top Keno Advertisement, written by Aristocrat, published Oct. 2000.
Bing Ball Bingo Advertisement, written by BCSI Corporation, published prior to 2003.
Bingo Advertisement and Jackpot Bingo Advertisements, written by Casino Data Systems, published in 1998 and 2001.
Bingo Brasil Advertisement, written by Unidesa Gaming, published prior to 2003.
Bingo Game Station Advertisement, written by Cole Gaming Technologies, published prior to 2003.
Bingo Party Advertisement, written by Amatic Industries, published 2001.
Bingo Slot Advertisement, written by Unidesa Gaming, published prior to 2003.
Bingo Wizard Advertisement, written by Applied Concepts, published 2002.
Bingo Advertisement, written by WMS Gaming, Inc., published prior to 2003.
Bonus Bingo Advertisement, written by Unidesa Gaming, published prior to 2003.
Canadian Bingo Advertisement, written by Unidesa Gaming, published prior to 2003.
Cash Express Advertisements, written by Aristocrat, published in 2002.
Cash Keno Advertisement, written by IGT, available prior to 2003.
Cleopatra Bingo Advertisement, written by IGT, published in 2000 and 2004.
Dual Screen Keno Machine Picture Advertisement, written by Acres Gaming, Inc., published prior to 2003.
Five Card Instant Bingo Advertisement written by IGT, published in 2000.
Flamingo Reno-Keno, written by Flamingo Reno, published prior to 2003.
Instant Bingo Video Slots Advertisement, written by IGT, published 2002.
Keno Advertisement, written by Odds on Gaming, published prior to 2003.
New Games Rollout at G2E, written by Indian Gaming, published Nov. 2006.
Party Time Bingo Advertisement, written by Astra Games Limited, published prior to 2003.
Reel Bingo Advertisement, written by B Soft, published prior to 2003.
Slot Line MEGA JACKPOTS™ Advertisement written by IGT, published in 1997.
Ultimate Keno Advertisement, written by Bally Gaming Systems, published 2000.

* cited by examiner

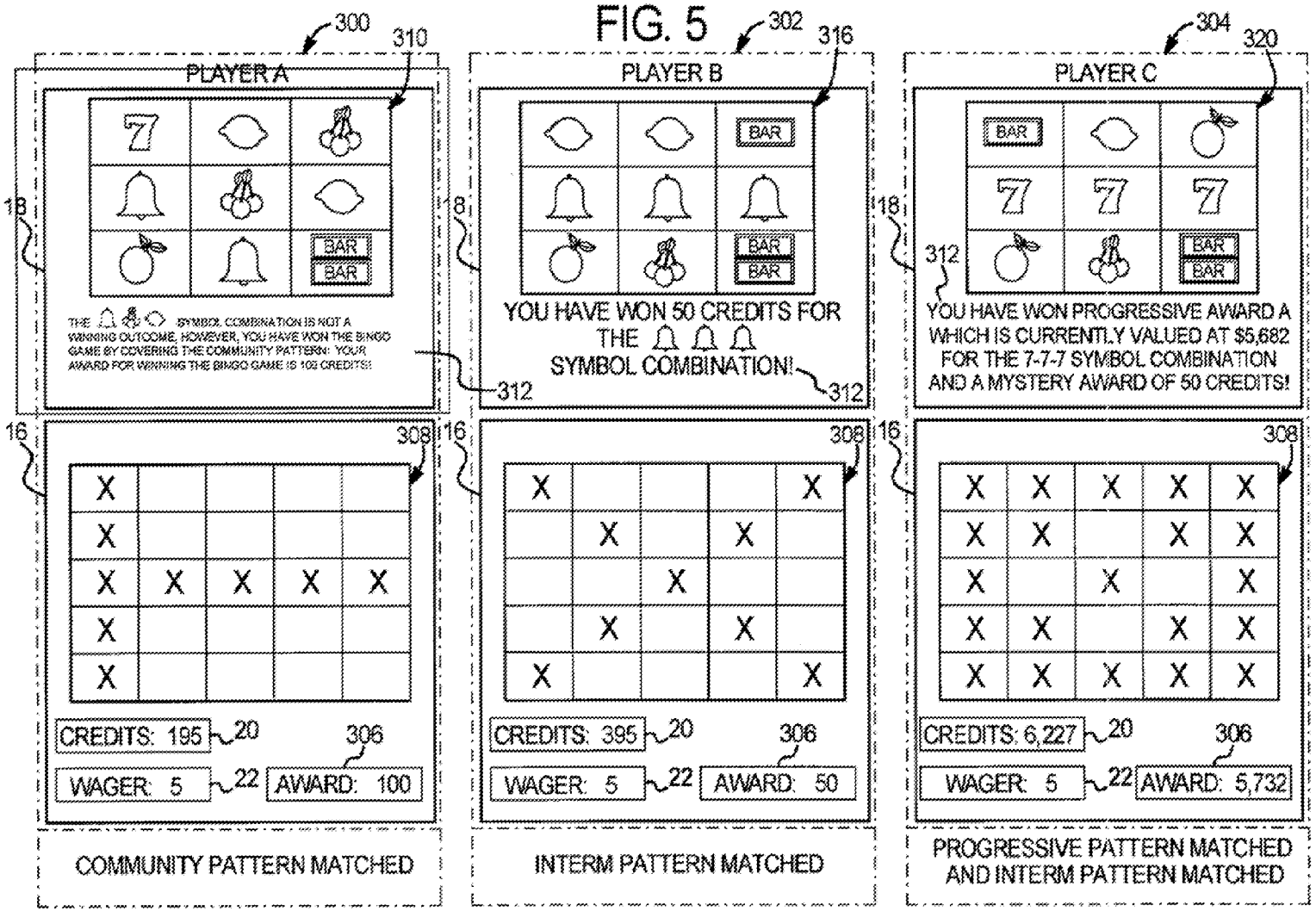
FIG. 5
300
PLAYER A
310
THE SYMBOL COMBINATION IS NOT A WINNING OUTCOME. HOWEVER, YOU HAVE WON THE BINGO GAME BY COVERING THE COMMUNITY PATTERN! YOUR AWARD FOR WINNING THE BINGO GAME IS 100 CREDITS!
18
312
16
308
CREDITS: 195
20
WAGER: 5
22
AWARD: 100
306
COMMUNITY PATTERN MATCHED
302
PLAYER B
316
YOU HAVE WON 50 CREDITS FOR THE SYMBOL COMBINATION!
18
312
16
308
CREDITS: 395
20
WAGER: 5
22
AWARD: 50
306
INTERM PATTERN MATCHED
304
PLAYER C
320
YOU HAVE WON PROGRESSIVE AWARD A WHICH IS CURRENTLY VALUED AT $5,682 FOR THE 7-7-7 SYMBOL COMBINATION AND A MYSTERY AWARD OF 50 CREDITS!
18
312
16
308
CREDITS: 6,227
20
WAGER: 5
22
AWARD: 5,732
306
PROGRESSIVE PATTERN MATCHED AND INTERM PATTERN MATCHED FIG. 7
400
| BINGO PATTERN (402) | SEED (404) | PROGRESSIVE AWARD (406) | VALUE OF INCIDENTAL AWARD (408) | SYMBOL COMBINATION DISPLAYED TO PLAYER (410) |
|---|---|---|---|---|
| 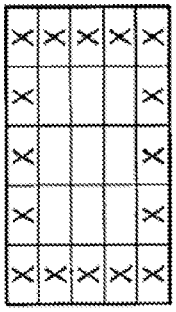 | #1 | A | NONE | 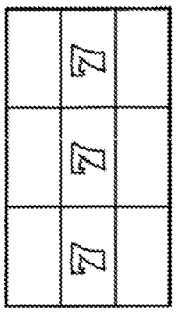 |
| 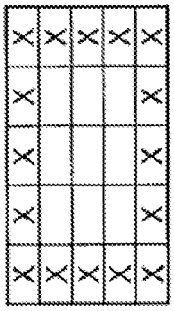 | #2 | A | 20 CREDITS | 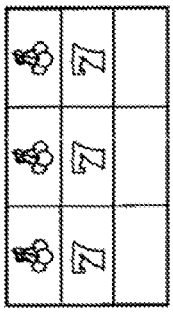 |
| 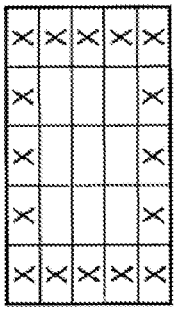 | #3 | A | 50 CREDITS | 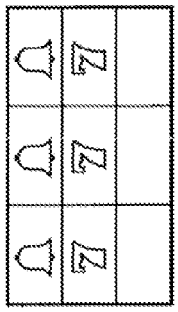 |
| 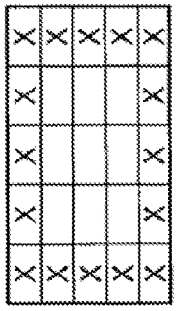 | #4 | A | 100 CREDITS | 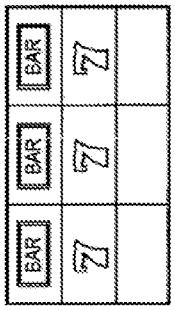 |

BINGO GAMING SYSTEM AND METHOD FOR PROVIDING MULTIPLE OUTCOMES FROM SINGLE BINGO PATTERN

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming in the United States is typically divided into Class I, Class II, and Class III games. Class I gaming includes social games played for minimal prizes, or traditional ceremonial games. Class II gaming includes bingo and bingo-like games. Class III gaming includes any game that is not a Class I or Class II game, such as games of chance (e.g., slot machine games, video poker games, video blackjack games, and video Keno games) typically offered in state-regulated casinos.

One form of bingo includes providing a player one or more cards each bearing numbers. In this form of bingo, numbered objects are drawn or electronically determined and the player attempts to match the drawn numbered objects to the numbers on the player's card(s). If the drawn numbered objects match one of or a plurality of predetermined award patterns on the player's card(s), the player wins an award associated with that predetermined award pattern.

In general, certain players find slot machines to be more appealing than bingo games. Typically, slot machines generate symbols which are displayed on the reels. However, as mentioned above, slot machines and other games of chance fall into the category of Class III games, which may be subject to stricter approval and regulation and not available in certain jurisdictions or states where Class II games are available. Accordingly, certain known bingo systems display a bingo outcome to players by, in addition to displaying the bingo game, simulating the appearance of traditional Class III games, such as by utilizing a slot game to display an outcome which corresponds with the outcome of the bingo game.

In such bingo systems that display a bingo outcome by simulating the appearance of a traditional Class III game, an award typically referred to as a community award is won by the first player who is playing a bingo card on which a game-winning pattern or community pattern of numbers is covered. Once the game-winning pattern of numbers is covered, the bingo system provides the community award to the first player and terminates the bingo game.

After the bingo game is terminated (i.e., the community pattern is covered), a determination occurs for each bingo card whether any covered pattern is a designated pattern associated with an award. One form of designated patterns are interim patterns which are associated with interim or supplemental awards. If an interim pattern is covered (within a quantity of numbered objects drawn) on one of the bingo cards of one of the players, the bingo system provides an interim or supplemental award to that player separate from the community award. That is, a player can win an interim or supplemental award with or without winning the community award. For example, a L-shaped interim pattern in the bingo game is associated with ten credits and fifteen numbered objects drawn. In this example, if the L-shaped interim pattern is covered within the first fifteen numbered objects drawn in the bingo game before the community pattern is covered, the bingo system determines a symbol combination to display based on the ten credits associated with the L-shaped interim pattern. In this example, if a symbol combination of BAR-BAR-BAR is associated with ten credits (according to an applicable paytable), the bingo system displays the symbol combination of BAR-BAR-BAR and provides the ten credits for the symbol combination of BAR-BAR-BAR. That is, the symbol combination of BAR-BAR-BAR in the slot game represents the covered L-shaped interim pattern in the bingo game. In such a bingo system, the interim patterns are ranked or otherwise ordered form highest priority to lowest priority. If a plurality of interim patterns are each covered (within the quantity of numbered objects drawn associated with each respective interim pattern) in the bingo game, the bingo system determines the covered interim pattern of the highest priority and provides the player the award associated with only the highest priority covered interim pattern.

Such bingo systems also include progressive awards, or open-ended awards, which are generally more desirable awards and can increment to high values. Such progressive awards are typically provided to any player playing a bingo card on which one of a plurality of predetermined progressive award patterns of numbers is covered on the bingo card within a quantity of numbered objects drawn. If a progressive award pattern is covered (within a quantity of numbered objects drawn) on one of the bingo cards of one of the players, the bingo system provides a progressive award to that player separate from any community award and any interim awards. That is, a player can win a progressive award with or without winning the community award or an interim award. For example, a X-shaped progressive pattern in the bingo game is associated with a progressive award and eight numbered objects drawn. In this example, if the X-shaped pattern is covered within the first eight numbered objects drawn in the bingo game before the community pattern is covered, the bingo system provides the progressive award as a mystery award to that player. That is, the progressive award is provided independent of any displayed symbol combination. In such a bingo system, the progressive award patterns are ranked or otherwise ordered form highest priority to lowest priority. If a plurality of progressive award patterns are each covered (within the quantity of numbered objects drawn associated with each respective progressive award pattern) in the bingo game, the bingo system determines the covered progressive award pattern of the highest priority and provides the player the award associated with only the highest priority covered progressive award pattern.

In certain bingo systems, any player may potentially cover an interim pattern and a progressive pattern during the same draw of numbered objects. In these games, if one of the interim patterns and one of the progressive patterns are simultaneously covered, the bingo system is conflicted with which symbol combination to display. It would be confusing, for a player to win a progressive award based on a displayed symbol combination in one play of the game and in a subsequent play of the game, for the player to win the same progressive award independent of any displayed symbol combination. Because such potential conflict exists, known bingo systems do not provide progressive awards as symbol driven progressive awards (i.e., progressive awards based on any displayed symbol or symbol combination). Rather, known bingo systems generate the symbol combination associated with the same value as the value associated with the covered interim pattern and provide any progressive awards won by the player as mystery progressive awards. That is, the progressive awards are provided independent of any displayed symbol or symbol combination regardless of whether an interim pattern, a progressive pattern or both are covered.

Providing the progressive awards as mystery awards reduces, or at least mitigates, player confusion which could be caused by providing the progressive awards in different ways (e.g., as symbol driven progressive awards and mystery progressive awards) for different plays of the same game. Accordingly, by providing the progressive awards as mystery awards, known bingo systems maintain consistency in how the progressive awards are provided to the players for each play of the bingo game. Additionally, certain players are confused by mystery wins and prefer wins based on displayed symbol combinations. Specifically, these players prefer any progressive wins to be displayed as symbol combinations because these players then know why and how they are provided such large awards. Accordingly, bingo systems which provide progressive awards as mystery awards confuses these players because they do not know why or how they are provided such large awards.

There is a continuing need to provide new and different gaming machines and gaming systems as well as new and different ways to display game outcomes and awards to players. There is also a continuing need to provide new and different linked or related gaming machines which provide progressive awards.

SUMMARY

In one embodiment, the gaming system and method disclosed herein provides a bingo game wherein at least one bingo pattern has a plurality of outcomes. In one such embodiment, a first bingo pattern (or a first part of a bingo pattern), such as an interim pattern, is associated with a static or interim outcome, such as an award of a designated value, and a second bingo pattern (or a second part of the bingo pattern), such as a progressive pattern, is associated with an open-ended outcome, such as a progressive award. The gaming system and method disclosed herein provides a bingo game in which any bingo outcome that corresponds to an open-ended outcome is displayed or represented to the player with a symbol or symbol combination and the static outcome is provided as a mystery award. By displaying the open-ended outcomes as symbol-driven outcomes, the gaming system and method reduces the confusion for certain players as to how and why such open-ended awards are provided to the player.

In one embodiment, prior to any play of the bingo game, the gaming system disclosed herein determines or otherwise constructs a list of progressive award bingo patterns. The list of progressive patterns includes, for each progressive pattern, the spots which are to be covered on the bingo card, the number of balls drawn in which such spots must be covered, the progressive award associated with such a progressive pattern and any residual or incidental awards (as described below) associated with that progressive pattern. The gaming system then sorts these progressive patterns from highest priority to lowest priority. Sorting of these progressive patterns provides that for the play of the bingo game, the player is either provided: (i) no progressive award (i.e., if no progressive pattern is covered), (ii) one progressive award (i.e., the highest priority progressive pattern that is covered if a plurality of progressive patterns are each covered) without any residual awards, or (iii) one progressive award (i.e., the highest priority progressive pattern that is covered if a plurality of progressive patterns are each covered) and one or more residual awards associated with that progressive pattern. Accordingly, as only the highest priority covered progressive pattern is provided, each progressive pattern's probability (and thus the probability of winning the progressive award associated with that progressive pattern) is determined by the spots which are to be covered on the bingo card, the number of balls drawn in which such spots must be covered and the probability of also hitting a higher priority progressive pattern.

In one embodiment, when constructing the list of progressive patterns, the gaming system also associates each progressive pattern with one or more seeds. The seed or seeds associated with each progressive pattern include information or data regarding how the progressive award associated with that progressive pattern will be displayed to the player. In one such embodiment, such information or data relates to the symbol combination corresponding to the progressive award (and any symbol combination corresponding to any residual awards) that will be displayed to the player if that progressive pattern is covered. It should be appreciated that when associating one or more seeds to a specific progressive pattern, the gaming system disclosed herein accounts for the probability of the different available symbol combinations being randomly generated and the probability of that progressive pattern also being covered. Accordingly, the gaming system disclosed herein provides that a seed having data relating to a designated symbol combination (that is associated with the progressive award) which has a probability of being randomly generated and displayed is associated with a progressive pattern which has substantially the same probability of being covered for a play of the bingo game. Such a configuration provides that the probability of different symbol combinations being displayed to the player in the Class II bingo game disclosed herein substantially mirrors the probability of different symbol combinations being displayed to the player in a Class III game.

In addition to constructing the list of progressive patterns, the gaming system also constructs a list of interim bingo patterns. The list of interim patterns includes, for each interim pattern, the spots which are to be covered on the bingo card, the number of balls drawn in which such spots must be covered, the interim award associated with such an interim pattern and one or more seeds which each include information or data regarding how the interim award associated with that interim pattern may be displayed to the player (i.e., which symbol or symbol combinations to display to the player if that interim pattern is covered and no progressive pattern is also covered). The gaming system then sorts these interim patterns from highest priority to lowest such that for any play of the bingo game, the player is either provided no interim awards (i.e., if no interim pattern is covered) or provided one interim award (i.e., the highest priority interim pattern that is covered if a plurality of interim patterns are each covered). Accordingly, as only the highest priority covered interim pattern is provided, each interim pattern's probability is determined by the spots which are to be covered on the bingo card, the number of balls drawn in which such spots must be covered and the probability of also hitting a higher priority interim pattern.

In one embodiment, the gaming system draws objects or numbers for the play of the bingo game wherein the bingo game ends when a game-winning pattern or community pattern of numbers is covered on a bingo card being played by one of the players. The bingo system provides a game-winning award or a community award to the first player who covered the game-winning or community pattern. In this embodiment, if an interim pattern (or part of a bingo pattern associated with the interim pattern) is covered and a progressive pattern is not covered when the bingo game ends, the gaming system utilizes a seed associated with the covered interim pattern to display a symbol combination corresponding to the interim award of the covered interim pattern. On the other hand, if a progressive pattern (or part of a bingo pattern associated with the progressive pattern) is covered and an interim pattern is not covered when the bingo game ends, the gaming system utilizes a seed associated with the covered progressive pattern to display: (i) a symbol combination corresponding to the progressive award of the covered progressive pattern, and (ii) any symbol combination corresponding to any residual award of the covered progressive pattern. Moreover, if an interim pattern and a progressive pattern are both covered when the bingo game ends, the gaming system: (i) utilizes a seed associated with the covered progressive pattern to display a symbol combination corresponding to the progressive award of the covered progressive pattern, (ii) utilizes the seed associated with the covered progressive pattern to display any symbol combination corresponding to any residual award of the covered progressive pattern and (iii) causes the interim award to be provided to the player as a mystery award. The disclosed gaming system and method thus provides consistency for players that win a progressive award because the progressive award is based on a displayed symbol combination in one play of the game and in a subsequent play of the game, the same progressive award is based, at least in part, on the same displayed symbol combination.

For example, an interim pattern is associated with ten credits and a progressive pattern is associated with a progressive award. In this example, if an interim pattern is covered in the bingo game (and a progressive pattern is not covered when the bingo game ends), the gaming system determines which symbol combination to display based on the ten credits associated with the interim pattern. In this example, if a symbol combination of BELL-BELL-BELL is associated with ten credits (according to an applicable paytable), the gaming system displays the symbol combination of BELL-BELL-BELL and provides the ten credits for the symbol combination of BELL-BELL-BELL. That is, the symbol combination of BELL-BELL-BELL in the slot game represents the interim pattern being covered in the bingo game.

Continuing with this example, if a progressive pattern is covered in the bingo game (and an interim pattern is not covered when the bingo game ends), the gaming system determines which symbol combination to display based on the progressive award associated with the progressive pattern. For example, if a symbol combination of 7-7-7 is associated with the progressive award (according to an applicable paytable), the gaming system displays the symbol combination of 7-7-7 and provides the progressive award to the player. That is, the symbol combination of 7-7-7 in the slot game represents the progressive pattern being covered in the bingo game.

Moreover, in this example, if an interim pattern and a progressive pattern are both covered when the bingo game ends, the disclosed gaming system provides the interim outcome to the player as a mystery award, displays the symbol combination associated with the progressive award (i.e., 7-7-7) and provides the progressive award to the player. That is, the progressive award is provided based on symbols or symbol combinations displayed by the slot game regardless of whether the interim pattern, the progressive pattern or both patterns are covered. Because the symbol combination associated with the progressive award is generated and displayed by the gaming system, any interim outcomes or interim awards are provided as mystery awards.

Providing the progressive award as a symbol driven award (i) informs players as to how and why the progressive award is being provided for each bingo game, and (ii) creates additional opportunities for the player to win residual awards as described below. Accordingly, by providing the progressive award as a symbol driven progressive award, the disclosed gaming system and method maintains consistency in how the progressive award is provided to the players for each bingo game.

In one embodiment, as mentioned above, one or more progressive award patterns or progressive patterns are each associated with a plurality of seeds. Each seed includes a displayed slot machine outcome (i.e., a symbol combination as in traditional Class III gaming) which represents the progressive pattern being covered. In this embodiment, if the progressive pattern is covered, the gaming system selects one of the seeds associated with the covered progressive pattern. Depending upon which seed is selected, the gaming system displays the symbol combination which corresponds to the selected seed. For example, after the progressive pattern is covered, if the gaming system selects a first one of the seeds associated with the covered progressive pattern, the gaming system displays the symbol combination associated with the progressive award (e.g., 7-7-7) along a first payline of the slot game. If the gaming system selects a second one of the seeds associated with the covered progressive pattern, the gaming system displays the symbol combination associated with the progressive award (e.g., 7-7-7) along a second, different payline of the slot game.

In one such embodiment, at least one of the seeds associated with a progressive pattern is also associated with a second, different symbol combination which corresponds to a residual or incidental award. That is, at least one of the seeds is associated with a first symbol combination which corresponds to the progressive award and a second, different symbol combination which corresponds to a residual or incidental award. In one such embodiment, if the gaming system selects the seed associated with the first and second symbol combinations, the gaming system displays the symbol combination associated with the progressive award (e.g., 7-7-7) along a first payline of the slot game and displays a symbol combination associated with the residual or incidental award (e.g., BAR-BAR-BAR) along a second, different payline of the slot game. In this embodiment, the gaming system provides the player with the progressive award associated with the displayed symbol combination (e.g., 7-7-7) in addition to the residual or incidental award associated with the displayed symbol combination (e.g., BAR-BAR-BAR). Accordingly, the gaming system and method disclosed herein associates a plurality of outcomes with a single bingo outcome, which provides additional opportunities for the player to win awards. Such a configuration enables the gaming system to provide a bingo game with an element of variety in the symbols displayed to the player (for each progressive win) and the total awards provided to the player (for each progressive win). In other words, the gaming system is configured to display different residual awards and different symbol combinations for each of a plurality of different times the same progressive award is won.

Additionally, the gaming system and method disclosed herein provides a significant advantage by providing an accurate way to display or represent multiple outcomes for a single bingo pattern in a bingo game. Further, the gaming system and method disclosed herein provides a significant advantage by providing a plurality of ways to map a variety of Class III game outcomes to a common set of bingo patterns.

Another advantage provided by the gaming system and method disclosed herein includes maintaining consistency in how the progressive awards are provided to the players for each play of the bingo game. By providing the progressive awards as symbol-driven awards, the gaming system and method disclosed herein reduces, or at least mitigates, player confusion which could be caused by providing the progressive awards in different ways (e.g., as symbol driven progressive awards and mystery progressive awards) for different plays of the same bingo game. Accordingly, by consistently providing the progressive awards as symbol-driven progressive awards, the gaming system and method disclosed herein displays symbol combinations which indicate why and how the player is being provided such large progressive awards.

Additional features and advantages are described herein, and will be apparent from the following Detailed Description and the figures.

BRIEF DESCRIPTION OF THE FIGURES

FIG. 5 is an enlarged front plan view of a plurality of display devices of a plurality of gaming devices disclosed herein, illustrating an example of one embodiment of the present disclosure where certain events occur in association with a bingo game displayed to a plurality of players.

FIG. 7 is an example table showing a progressive pattern being associated with a plurality of seeds, illustrating an example of one embodiment of the present disclosure where each progressive pattern is associated with at least one seed and at least one symbol combination.

DETAILED DESCRIPTION

Figure 1A:
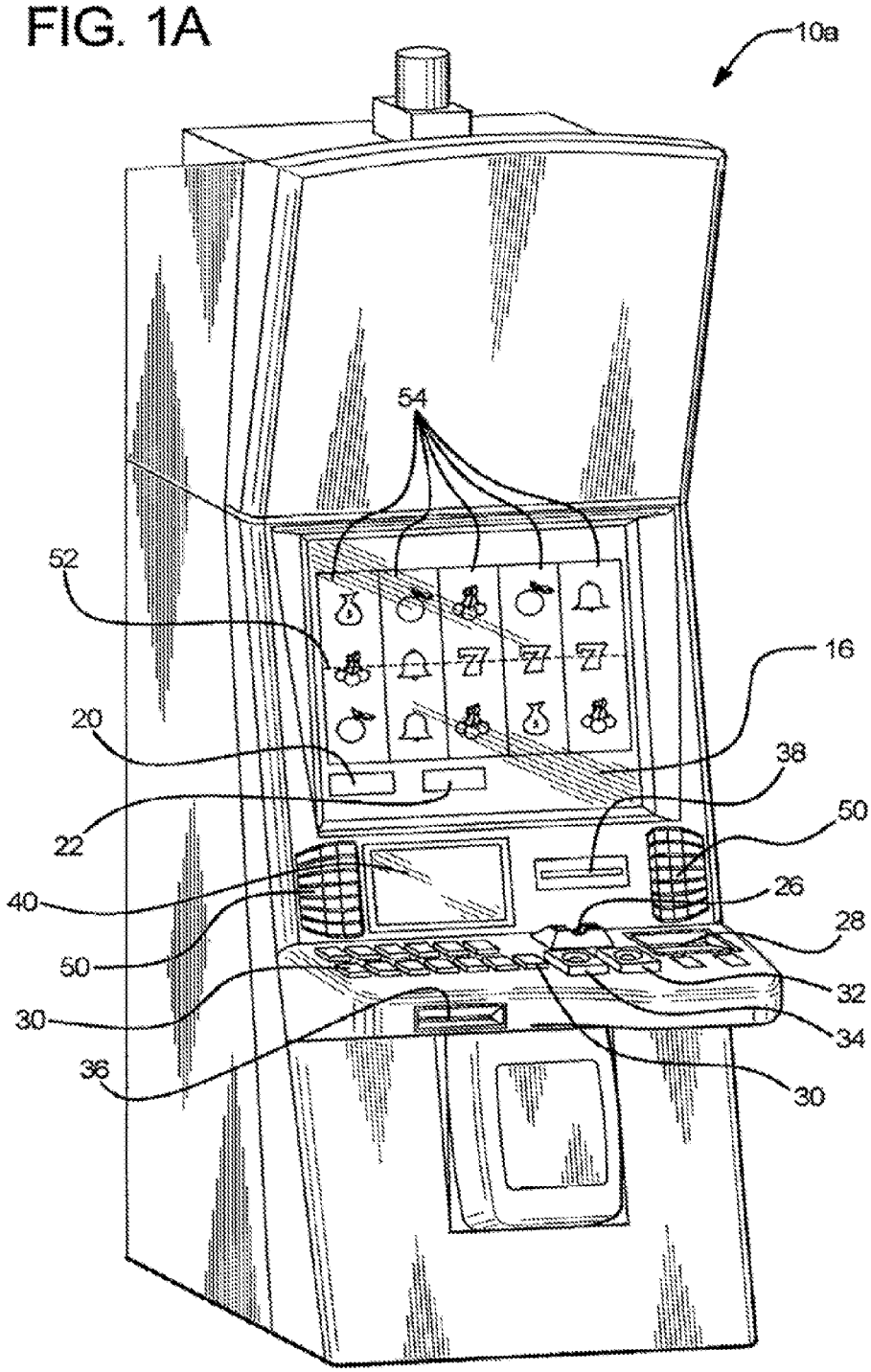
FIGS. 1A and 1B are perspective views of example alternative embodiments of the gaming system of the present disclosure.

In various embodiments, as further described below, the gaming system disclosed herein provides that a predetermined game outcome value is determined for each of a plurality of linked or networked gaming devices based on the results of an electronic bingo, keno, or lottery game. In this embodiment, each individual gaming device utilizes one or more electronic bingo, keno, or lottery games to determine the predetermined game outcome value provided to the player for the interactive game played at that gaming device. In one embodiment, the bingo, keno, or lottery game is displayed to the player and the results of the bingo, keno, or lottery game determine the predetermined game outcome value provided to the player and displayed by a primary or secondary game, such as a slot game having a plurality of reels. In another embodiment, the bingo, keno, or lottery game is not displayed to the player, but the results of the bingo, keno, or lottery game determine the predetermined game outcome value for a primary or secondary game, such as a slot game having a plurality of reels. It should be appreciated that other suitable methods for displaying one or more predetermined game outcomes representing the results of the bingo, keno, or lottery game may be employed. For example, in one such embodiment, the results of the bingo, keno, or lottery game determine the predetermined game outcome value for different primary wagering games, such as video poker games, video blackjack games, video keno or any other suitable primary or secondary game.

The present disclosure may be implemented in various configurations for gaming machines, gaming devices, or gaming systems, including but not limited to: (1) a dedicated gaming machine, gaming device, or gaming system wherein the computerized instructions for controlling any games (which are provided by the gaming machine or gaming device) are provided with the gaming machine or gaming device prior to delivery to a gaming establishment; and (2) a changeable gaming machine, gaming device, or gaming system wherein the computerized instructions for controlling any games (which are provided by the gaming machine or gaming device) are downloadable to the gaming machine or gaming device through a data network after the gaming machine or gaming device is in a gaming establishment. In one embodiment, the computerized instructions for controlling any games are executed by at least one central server, central controller, or remote host. In such a "thin client" embodiment, the central server remotely controls any games (or other suitable interfaces) and the gaming device is utilized to display such games (or suitable interfaces) and receive one or more inputs or commands from a player. In another embodiment, the computerized instructions for controlling any games are communicated from the central server, central controller, or remote host to a gaming device local processor and memory devices. In such a "thick client" embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling any primary games are communicated from the central server to the gaming device in a thick client configuration and computerized instructions for controlling any secondary games or bonus functions are executed by a central server in a thin client configuration.

Figure 1B:
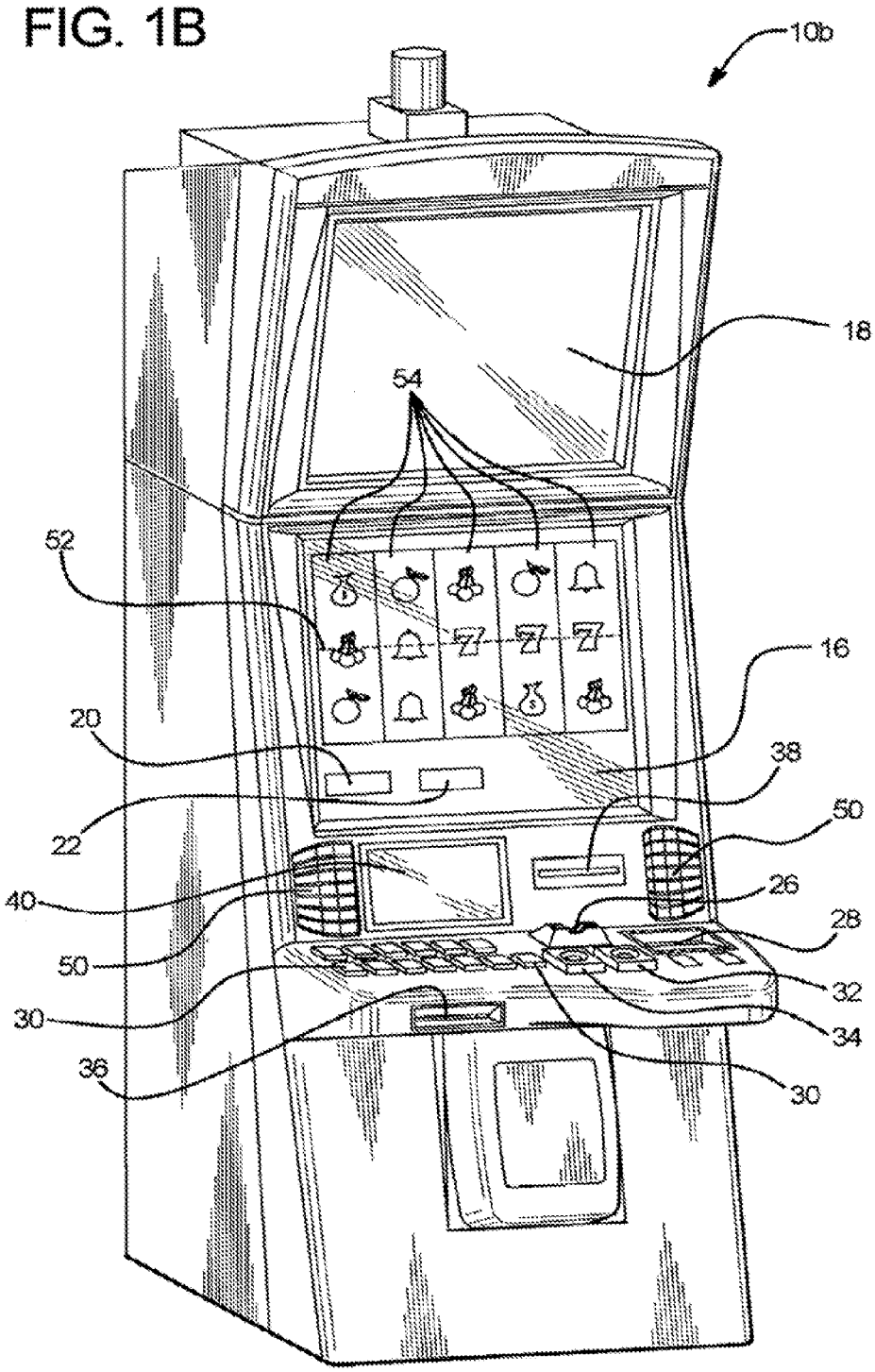

Referring now to the drawings, two example alternative embodiments of a gaming device disclosed herein are illustrated in FIGS. 1A and 1B as gaming device 10*a* and gaming device 10*b*, respectively. Gaming device 10*a* and/or gaming device 10*b* are generally referred to herein as gaming device 10.

In the embodiments illustrated in FIGS. 1A and 1B, gaming device 10 has a support structure, housing, or cabinet which provides support for a plurality of displays, inputs, controls, and other features of a conventional gaming machine. It is configured so that a player can operate it while standing or sitting. The gaming device can be positioned on a base or stand or can be configured as a pub-style table-top game (not shown) which a player can operate preferably while sitting. As illustrated by the different configurations shown in FIGS. 1A and 1B, the gaming device may have varying cabinet and display configurations.

Figure 2A:
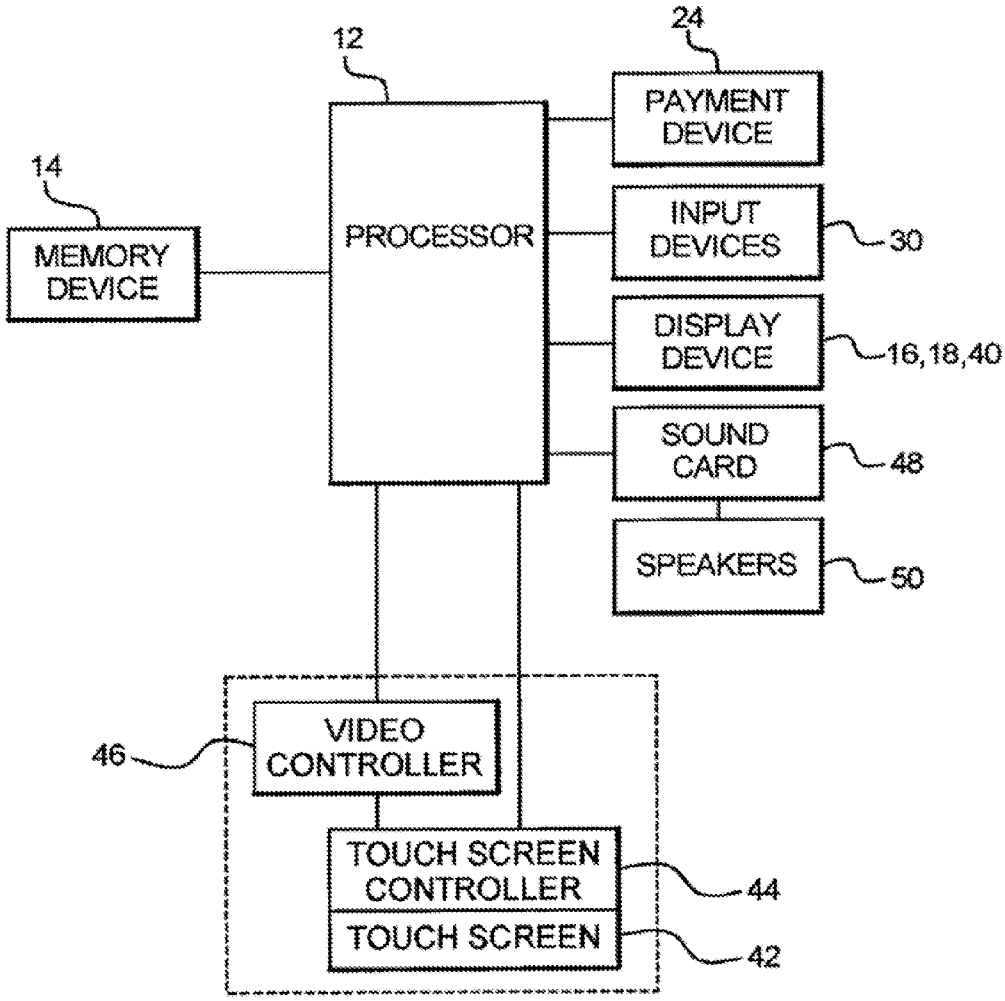
FIG. 2A is a schematic block diagram of one embodiment of an electronic configuration for one of the gaming systems disclosed herein.

In one embodiment, as illustrated in FIG. 2A, the gaming device preferably includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information, and applicable game rules that relate to the play of the gaming device. In one embodiment, the memory device includes random access memory (RAM), which can include non-volatile RAM (NVRAM), magnetic RAM (MRAM), ferroelectric RAM (FeRAM), and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical, and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD, or USB memory device. In other embodiments, part or all of the program code and/or operating data described above can be downloaded to the memory device through a suitable network.

In one embodiment, an operator or a player can use such a removable memory device in a desktop computer, a laptop computer, a personal digital assistant (PDA), a portable computing device, or another computerized platform to implement the present disclosure. In one embodiment, the gaming device or gaming machine disclosed herein is operable over a wireless network, for example part of a wireless gaming system. In this embodiment, the gaming machine may be a hand-held device, a mobile device, or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer" or "controller."

In another embodiment, as discussed in more detail below, the gaming device employs a predetermined or finite set or pool of awards or other game outcomes. In this embodiment, as each award or other game outcome is provided to the player, the gaming device flags or removes the provided award or other game outcome from the predetermined set or pool. Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In one embodiment, as illustrated in FIG. 2A, the gaming device includes one or more display devices controlled by the processor. The display devices are preferably connected to or mounted on the cabinet of the gaming device. The embodiment shown in FIG. 1A includes a central display device 16 which displays a primary game. This display device may also display any suitable secondary game associated with the primary game as well as information relating to the primary or secondary game. The alternative embodiment shown in FIG. 1B includes a central display device 16 and an upper display device 18. The upper display device may display the primary game, any suitable secondary game associated or not associated with the primary game and/or information relating to the primary or secondary game. These display devices may also serve as digital glass operable to advertise games or other aspects of the gaming establishment. As seen in FIGS. 1A and 1B, in one embodiment, the gaming device includes a credit display 20 which displays a player's current number of credits, cash, account balance, or the equivalent. In one embodiment, the gaming device includes a bet display 22 which displays a player's amount wagered. In one embodiment, as described in more detail below, the gaming device includes a player tracking display 40 which displays information regarding a player's play tracking status.

In another embodiment, at least one display device may be a mobile display device, such as a PDA or tablet PC, that enables play of at least a portion of the primary or secondary game at a location remote from the gaming device.

The display devices may include, without limitation, a monitor, a television display, a plasma display, a liquid crystal display (LCD) a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In one embodiment, as described in more detail below, the display device includes a touch-screen with an associated touch-screen controller. The display devices may be of any suitable size and configuration, such as a square, a rectangle or an elongated rectangle.

The display devices of the gaming device are configured to display at least one and preferably a plurality of game or other suitable images, symbols and indicia such as any visual representation or exhibition of the movement of objects such as mechanical, virtual, or video reels and wheels, dynamic lighting, video images, images of people, characters, places, things, faces of cards, and the like. In one embodiment, the display devices of the gaming device are configured to display the results of the bingo game in addition to how a predetermined game outcome value is provided to a player for a play of a primary or secondary game.

In one alternative embodiment, the symbols, images and indicia displayed on or of the display device may be in mechanical form. That is, the display device may include any electromechanical device, such as one or more mechanical objects, such as one or more rotatable wheels, reels, or dice, configured to display at least one or a plurality of game or other suitable images, symbols or indicia. In one embodiment, an electromechanical display device, such as one or more rotatable wheels, reels, or dice, display the predetermined game outcome value of the primary or secondary game which represents the results of the bingo game.

As illustrated in FIG. 2A, in one embodiment, the gaming device includes at least one payment device 24 in communication with the processor. As seen in FIGS. 1A and 1B, a payment device such as a payment acceptor includes a note, ticket or bill acceptor 28 wherein the player inserts paper money, a ticket, or voucher and a coin slot 26 where the player inserts money, coins, or tokens. In other embodiments, payment devices such as readers or validators for credit cards, debit cards or credit slips may accept payment. In one embodiment, a player may insert an identification card into a card reader of the gaming device. In one embodiment, the identification card is a smart card having a programmed microchip, a coded magnetic strip or coded rewritable magnetic strip, wherein the programmed microchip or magnetic strips are coded with a player's identification, credit totals (or related data), and/or other relevant information. In another embodiment, a player may carry a portable device, such as a cell phone, a radio frequency identification tag, or any other suitable wireless device, which communicates a player's identification, credit totals (or related data), and other relevant information to the gaming device. In one embodiment, money may be transferred to a gaming device through electronic funds transfer. When a player funds the gaming device, the processor determines the amount of funds entered and displays the corresponding amount on the credit or other suitable display as described above.

As seen in FIGS. 1A, 1B, and 2A, in one embodiment the gaming device includes at least one and preferably a plurality of input devices 30 in communication with the processor. The input devices can include any suitable device which enables the player to produce an input signal which is received by the processor. In one embodiment, after appropriate funding of the gaming device, the input device is a game activation device, such as a play button 32 or a pull arm (not shown) which is used by the player to start any primary game or sequence of events in the gaming device. The play button can be any suitable play activator such as a bet one button, a max bet button, or a repeat the bet button. In one embodiment, upon appropriate funding, the gaming device begins the game play automatically. In another embodiment, upon the player engaging one of the play buttons, the gaming device automatically activates game play.

In one embodiment, one input device is a bet one button. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 34. The player may push the cash out button and cash out to receive a cash payment or other suitable form of payment corresponding to the number of remaining credits. In one embodiment, when the player cashes out, a payment device, such as a ticket, payment, or note generator 36 prints or otherwise generates a ticket or credit slip to provide to the player. The player receives the ticket or credit slip and may redeem the value associated with the ticket or credit slip via a cashier (or other suitable redemption system). In another embodiment, when the player cashes out, the player receives the coins or tokens in a coin payout tray. It should be appreciated that any suitable payout mechanisms, such as funding to the player's electronically recordable identification card or smart card, may be implemented in accordance with the gaming device disclosed herein.

In one embodiment, as mentioned above and as seen in FIG. 2A, one input device is a touch-screen 42 coupled with a touch-screen controller 44 or some other touch-sensitive display overlay to allow for player interaction with the images on the display. The touch-screen and the touch-screen controller are connected to a video controller 46. A player can make decisions and input signals into the gaming device by touching the touch-screen at the appropriate locations. One such input device is a conventional touch-screen button panel.

The gaming device may further include a plurality of communication ports for enabling communication of the processor with external peripherals, such as external video sources, expansion buses, game or other displays, a SCSI port, or a keypad.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as by playing music for the primary and/or secondary game or by playing music for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized to provide any appropriate information.

In one embodiment, the gaming machine may include a sensor, such as a camera, in communication with the processor (and possibly controlled by the processor), that is selectively positioned to acquire an image of a player actively using the gaming device and/or the surrounding area of the gaming device. In one embodiment, the camera may be configured to selectively acquire still or moving (e.g., video) images and may be configured to acquire the images in an analog, digital, or other suitable format. The display devices may be configured to display the image acquired by the camera as well as to display the visible manifestation of the game in split screen or picture-in-picture fashion. For example, the camera may acquire an image of the player and the processor may incorporate that image into the primary and/or secondary game as a game image, symbol or indicia.

To display the result of the bingo game disclosed herein, the gaming device 10 can incorporate any suitable wagering game as the primary or base game. The gaming machine or device may include some or all of the features of conventional gaming machines or devices. The primary or base game may comprise any suitable reel-type game, card game, cascading or falling symbol game, number game, or other game of chance susceptible to representation in an electronic or electromechanical form. That is, different primary wagering games, such as video poker games, video blackjack games, video keno, video bingo or any other suitable primary or base game may be implemented.

In one embodiment, as illustrated in FIGS. 1A and 1B, to display the result of the bingo game disclosed herein, the gaming device 10 can incorporate a slot game with one or more paylines 52. The paylines may be horizontal, vertical, circular, diagonal, angled or any combination thereof. In this embodiment, the gaming device includes at least one and preferably a plurality of reels 54, such as three to five reels 54, in either electromechanical form with mechanical rotating reels or video form with simulated reels and movement thereof. In one embodiment, an electromechanical slot machine includes a plurality of adjacent, rotatable reels which may be combined and operably coupled with an electronic display of any suitable type. In another embodiment, if the reels 54 are in video form, one or more of the display devices, as described above, displays the plurality of simulated video reels 54. Each reel 54 displays a plurality of indicia or symbols, such as bells, hearts, fruits, numbers, letters, bars, or other images which preferably correspond to a theme associated with the gaming device. In another embodiment, one or more of the reels are independent reels or unisymbol reels. In this embodiment, each independent or unisymbol reel generates and displays one symbol to the player. In one embodiment, the gaming device awards prizes after the reels of the primary game stop spinning if specified types and/or configurations of indicia or symbols occur on an active payline or otherwise occur in a winning pattern, occur on the requisite number of adjacent reels and/or occur in a scatter pay arrangement.

In an alternative embodiment, rather than displaying the determined game outcome which represents the results of the bingo game based on the symbols generated on any wagered upon paylines as described above, the gaming device determines which game outcome to represent the results of the bingo game based on the number of associated symbols which are generated in active symbol positions on the requisite number of adjacent reels (i.e., not on paylines passing through any displayed winning symbol combinations). In this embodiment, if a winning symbol combination is generated on the reels, the gaming device provides the player one award for that occurrence of the generated winning symbol combination. For example, if one winning symbol combination is generated on the reels, the gaming device will provide a single award to the player for that winning symbol combination (i.e., not based on the number of paylines that would have passed through that winning symbol combination). It should be appreciated that because a gaming device that enables displaying the results of the bingo game as ways to win provides the player one award for a single occurrence of a winning symbol combination and a gaming device with paylines may provide the player more than one award for the same occurrence of a single winning symbol combination (i.e., if a plurality of paylines each pass through the same winning symbol combination), it is possible to provide a player at a ways to win gaming device with more ways to win for an equivalent bet or wager on a traditional slot gaming device with paylines. It should be appreciated that even if the determined game outcome is displayed as a plurality of awards, the outcome of the bingo game is still provided to the player.

In one embodiment, the total number of ways to win is determined by multiplying the number of symbols generated in active symbol positions on a first reel by the number of symbols generated in active symbol positions on a second reel by the number of symbols generated in active symbol positions on a third reel and so on for each reel of the gaming device with at least one symbol generated in an active symbol position. For example, a three reel gaming device with three symbols generated in active symbol positions on each reel includes 27 ways to win (i.e., 3 symbols on the first reel×3 symbols on the second reel×3 symbols on the third reel). A four reel gaming device with three symbols generated in active symbol positions on each reel includes 81 ways to win (i.e., 3 symbols on the first reel×3 symbols on the second reel×3 symbols on the third reel×3 symbols on the fourth reel). A five reel gaming device with three symbols generated in active symbol positions on each reel includes 243 ways to win (i.e., 3 symbols on the first reel×3 symbols on the second reel×3 symbols on the third reel×3 symbols on the fourth reel×3 symbols on the fifth reel). It should be appreciated that modifying the number of generated symbols by either modifying the number of reels or modifying the number of symbols generated in active symbol positions by one or more of the reels modifies the number of ways to win.

In another embodiment, to display the result of the bingo game disclosed herein, the gaming device 10 enables a player to activate symbol positions. In one such embodiment, the symbol positions are on the reels. In this embodiment, if a reel is activated, then each of the symbol positions of that reel will be activated and each of the active symbol positions will be part of one or more of the ways to win. In one embodiment, if a reel is not activated, then a designated number of default symbol positions, such as a single symbol position of the middle row of the reel, will be activated and the default symbol position(s) will be part of one or more of the ways to win. In one embodiment, the gaming machine enables a player to wager on one, more than one or all of the reels and the processor of the gaming device uses the number of wagered on reels to determine the active symbol positions and the number of possible ways to win. In alternative embodiments, (1) no symbols are displayed as generated at any of the inactive symbol positions, or (2) any symbols generated at any inactive symbol positions may be displayed to the player but suitably shaded or otherwise designated as inactive.

In one embodiment wherein a player wagers on one or more reels, a player's wager of one credit may activate each of the three symbol positions on a first reel, wherein one default symbol position is activated on each of the remaining four reels. In this example, as described above, the gaming device provides the player three ways to win (i.e., 3 symbols on the first reel×1 symbol on the second reel×1 symbol on the third reel×1 symbol on the fourth reel×1 symbol on the fifth reel). In another example, a player's wager of nine credits may activate each of the three symbol positions on a first reel, each of the three symbol positions on a second reel and each of the three symbol positions on a third reel wherein one default symbol position is activated on each of the remaining two reels. In this example, as described above, the gaming device provides the player twenty-seven ways to win (i.e., 3 symbols on the first reel×3 symbols on the second reel×3 symbols on the third reel×1 symbol on the fourth reel×1 symbol on the fifth reel).

In one embodiment, to determine any award(s) to provide to the player based on the generated symbols, the gaming device individually determines if a symbol generated in an active symbol position on a first reel forms part of a winning symbol combination with or is otherwise suitably related to a symbol generated in an active symbol position on a second reel. In this embodiment, the gaming device classifies each pair of symbols which form part of a winning symbol combination (i.e., each pair of related symbols) as a string of related symbols. For example, if active symbol positions include a first cherry symbol generated in the top row of a first reel and a second cherry symbol generated in the bottom row of a second reel, the gaming device classifies the two cherry symbols as a string of related symbols because the two cherry symbols form part of a winning symbol combination.

After determining if any strings of related symbols are formed between the symbols on the first reel and the symbols on the second reel, the gaming device determines if any of the symbols from the next adjacent reel should be added to any of the formed strings of related symbols. In this embodiment, for a first of the classified strings of related symbols, the gaming device determines if any of the symbols generated by the next adjacent reel form part of a winning symbol combination or are otherwise related to the symbols of the first string of related symbols. If the gaming device determines that a symbol generated on the next adjacent reel is related to the symbols of the first string of related symbols, that symbol is subsequently added to the first string of related symbols. For example, if the first string of related symbols is the string of related cherry symbols and a related cherry symbol is generated in the middle row of the third reel, the gaming device adds the related cherry symbol generated on the third reel to the previously classified string of cherry symbols.

On the other hand, if the gaming device determines that no symbols generated on the next adjacent reel are related to the symbols of the first string of related symbols, the gaming device marks or flags such string of related symbols as complete. For example, if the first string of related symbols is the string of related cherry symbols and none of the symbols of the third reel are related to the cherry symbols of the previously classified string of cherry symbols, the gaming device marks or flags the string of two cherry symbols as complete.

After either adding a related symbol to the first string of related symbols or marking the first string of related symbols as complete, the gaming device proceeds as described above for each of the remaining classified strings of related symbols which were previously classified or formed from related symbols on the first and second reels.

After analyzing each of the remaining strings of related symbols, the gaming device determines, for each remaining pending or incomplete string of related symbols, if any of the symbols from the next adjacent reel, if any, should be added to any of the previously classified strings of related symbols. This process continues until either each string of related symbols is complete or there are no more adjacent reels of symbols to analyze. In this embodiment, where there are no more adjacent reels of symbols to analyze, the gaming device marks each of the remaining pending strings of related symbols as complete.

When each of the strings of related symbols is marked complete, the gaming device compares each of the strings of related symbols to an appropriate paytable and provides the player any award associated with each of the completed strings of symbols. It should be appreciated that the player is provided one award, if any, for each string of related symbols generated in active symbol positions (i.e., as opposed to a quantity of awards being based on how many paylines that would have passed through each of the strings of related symbols in active symbol positions).

In one embodiment, to display the result of the bingo game disclosed herein, the gaming device 10 can incorporate a poker game. In one such embodiment, the gaming device enables the player to play a conventional game of video draw poker and initially deals five cards all face up from a virtual deck of fifty-two cards. Cards may be dealt as in a traditional game of cards or in the case of the gaming device, the cards may be randomly selected from a predetermined number of cards. If the player wishes to draw, the player selects the cards to hold via one or more input devices, such as by pressing related hold buttons or via the touch screen. The player then presses the deal button and the unwanted or discarded cards are removed from the display and the gaming machine deals the replacement cards from the remaining cards in the deck. This results in a final five-card hand. The gaming device compares the final five-card hand to a payout table which utilizes conventional poker hand rankings to determine the winning hands. The gaming device provides the player with an award based on a winning hand and the number of credits the player wagered. In one embodiment, the results of the bingo game are displayed as a five-card poker hand that is evaluated on conventional poker hand rankings to determine the winning hands.

In another embodiment, to display the result of the bingo game disclosed herein, the gaming device 10 can incorporate a multi-hand version of video poker. In this embodiment, the gaming device deals the player at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand against a payout table and awards are provided to the player.

In one embodiment, a base or primary game may be a keno game wherein the gaming device displays a plurality of selectable indicia or numbers on at least one of the display devices. In this embodiment, the player selects at least one bit potentially a plurality of the selectable indicia or numbers via an input device such as a touch screen. The gaming device then displays a series of drawn numbers and determine an amount of matches, if any, between the player's selected numbers and the gaming device's drawn numbers. The player is provided an award based on the amount of matches, if any, based on the amount of determined matches and the number of numbers drawn. In one embodiment, to display the result of the bingo game disclosed herein, the gaming device 10 can incorporate a keno game, such as an electronic keno game.

In one embodiment, in addition to winning credits or other awards in a base or primary game, the gaming device may also give players the opportunity to win credits in a bonus or secondary game or in a bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game, and is accompanied with more attractive or unusual features than the base or primary game. In one embodiment, the bonus or secondary game may be any type of suitable game, either similar to or completely different from the base or primary game.

In one embodiment, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 1A and 1B. In other embodiments, the triggering event or qualifying condition occurs based on exceeding a certain amount of game play (such as number of games, number of credits, amount of time), or reaching a specified number of points earned during game play.

In another embodiment, the gaming device processor 12 or central controller 56 randomly provides the player one or more plays of one or more secondary games. In one such embodiment, the gaming device does not provide any apparent reason to the player for qualifying to play a secondary or bonus game. In this embodiment, qualifying for a bonus game is not triggered by an event in or based specifically on any of the plays of any primary game. That is, the gaming device may simply qualify a player to play a secondary game without any explanation or alternatively with simple explanations. In another embodiment, the gaming device (or central server) qualifies a player for a secondary game at least partially based on a game triggered or symbol triggered event, such as at least partially based on the play of a primary game.

In one embodiment, the gaming device includes a program which will automatically begin a bonus round after the player has achieved a triggering event or qualifying condition in the base or primary game. In another embodiment, after a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or exponential increase in the number of bonus wagering credits awarded. In one embodiment, the player may redeem extra bonus wagering credits during the bonus game to extend play of the bonus game.

In one embodiment, no separate entry fee or buy-in for a bonus game is needed. That is, a player may not purchase entry into a bonus game; rather they must win or earn entry through play of the primary game, thus encouraging play of the primary game. In another embodiment, qualification of the bonus or secondary game is accomplished through a simple "buy-in" by the player—for example, if the player has been unsuccessful at qualifying through other specified activities. In another embodiment, the player must make a separate side-wager on the bonus game or wager a designated amount in the primary game to qualify for the secondary game. In this embodiment, the secondary game triggering event must occur and the side-wager (or designated primary game wager amount) must have been placed to trigger the secondary game. It should be appreciated that the result of the bingo game includes the outcomes of both the primary game and the secondary game.

Figure 2B:
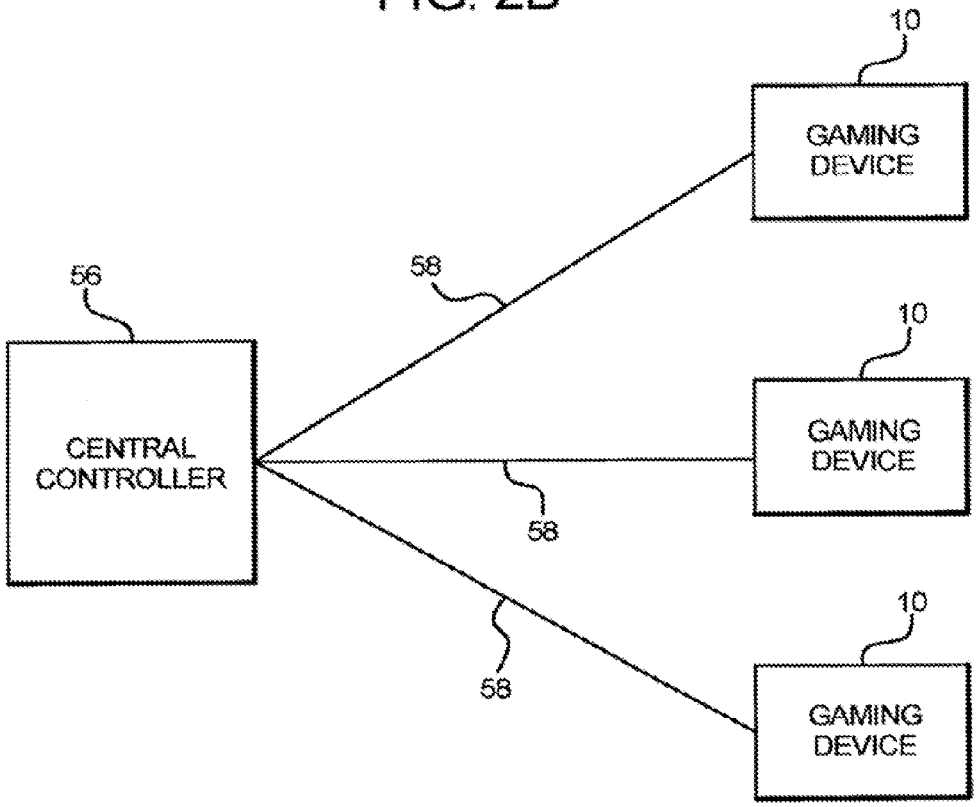
FIG. 2B is a schematic block diagram of one embodiment of a gaming system network configuration including a plurality of gaming devices disclosed herein.

In one embodiment, as illustrated in FIG. 2B, one or more of the gaming devices 10 are in communication with each other and/or at least one central controller 56 through a data network or remote communication link 58. In this embodiment, the central server, central controller or remote host is any suitable server or computing device which includes at least one processor and at least one memory or storage device. In different such embodiments, the central server is a progressive controller or a processor of one of the gaming devices in the gaming system. In these embodiments, the processor of each gaming device is designed to transmit and receive events, messages, commands, or any other suitable data or signal between the individual gaming device and the central server. The gaming device processor is operable to execute such communicated events, messages, or commands in conjunction with the operation of the gaming device. Moreover, the processor of the central server is designed to transmit and receive events, messages, commands, or any other suitable data or signal between the central server and each of the individual gaming devices. The central server processor is operable to execute such communicated events, messages, or commands in conjunction with the operation of the central server. It should be appreciated that one, more or each of the functions of the central controller, central server or remote host as disclosed herein may be performed by one or more gaming device processors. It should be further appreciated that one, more or each of the functions of one or more gaming device processors as disclosed herein may be performed by the central controller, central server or remote host.

In one embodiment, the game outcome provided to the player is determined by a central server or controller and provided to the player at the gaming device. In this embodiment, each of a plurality of such gaming devices are in communication with the central server or controller. Upon a player initiating game play at one of the gaming devices, the initiated gaming device communicates a game outcome request to the central server or controller.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such as free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility, and the like.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In one embodiment, the gaming device disclosed herein is associated with or otherwise integrated with one or more player tracking systems. Player tracking systems enable gaming establishments to recognize the value of customer loyalty through identifying frequent customers and rewarding them for their patronage. In one embodiment, the gaming device and/or player tracking system tracks any player's gaming activity at the gaming device. In one such embodiment, the gaming device includes at least one card reader 38 in communication with the processor. In this embodiment, a player is issued a player identification card which has an encoded player identification number that uniquely identifies the player. When a player inserts their playing tracking card into the card reader to begin a gaming session, the card reader reads the player identification number off the player tracking card to identify the player. The gaming device and/or associated player tracking system timely tracks any suitable information or data relating to the identified player's gaming session. Directly or via the central controller, the gaming device processor communicates such information to the player tracking system. The gaming device and/or associated player tracking system also timely tracks when a player removes their player tracking card when concluding play for that gaming session. In another embodiment, rather than requiring a player to insert a player tracking card, the gaming device utilizes one or more portable devices carried by a player, such as a cell phone, a radio frequency identification tag or any other suitable wireless device to track when a player begins and ends a gaming session. In another embodiment, the gaming device utilizes any suitable biometric technology or ticket technology to track when a player begins and ends a gaming session.

During one or more gaming sessions, the gaming device and/or player tracking system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In one embodiment, such tracked information and/or any suitable feature associated with the player tracking system is displayed on a player tracking display 40. In another embodiment, such tracked information and/or any suitable feature associated with the player tracking system is displayed via one or more service windows (not shown) which are displayed on the central display device and/or the upper display device.

In one embodiment, a plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to one another.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an internet game page from any location where an internet connection and computer or other internet facilitator is available. The expansion in the number of computers and number and speed of internet connections in recent years increases opportunities for players to play from an ever-increasing number of remote sites. It should be appreciated that the enhanced bandwidth of digital wireless communications may render such technology suitable for some or all communications, particularly if such communications are encrypted. Higher data transmission speeds may be useful for enhancing the sophistication and response of the display and interaction with the player.

As mentioned above, in one embodiment, the present disclosure may be employed in a server-based gaming system. In one such embodiment, as described above, one or more gaming devices are in communication with a central server or controller. The central server or controller may be any suitable server or computing device which includes at least one processor and a memory or storage device. In alternative embodiments, the central server is a progressive controller or another gaming machine in the gaming system. In one embodiment, the memory device of the central server stores different game programs and instructions, executable by a gaming device processor, to control the gaming device. Each executable game program represents a different game or type of game which may be played on one or more of the gaming devices in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, or downloading or streaming the game program over a dedicated data network, internet, or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of players at a plurality of linked gaming devices in a gaming system participate in a group gaming environment. In one embodiment, a plurality of players at a plurality of linked gaming devices work in conjunction with one another, such as by playing together as a team or group, to win one or more awards. In one such embodiment, any award won by the group is shared, either equally or based on any suitable criteria, amongst the different players of the group. In another embodiment, a plurality of players at a plurality of linked gaming devices compete against one another for one or more awards. In one such embodiment, a plurality of players at a plurality of linked gaming devices participate in a gaming tournament for one or more awards. In another embodiment, a plurality of players at a plurality of linked gaming devices play for one or more awards wherein an outcome generated by one gaming device affects the outcomes generated by one or more linked gaming devices.

In another embodiment, a plurality of gaming devices at one or more gaming sites may be networked to the central server in a progressive configuration, as known in the art, wherein a portion of each wager to initiate a base or primary game may be allocated to one or more progressive awards. In one embodiment, a progressive gaming system host site computer is coupled to a plurality of the central servers at a variety of mutually remote gaming sites for providing a multi-site linked progressive automated gaming system. In one embodiment, a progressive gaming system host site computer may serve gaming devices distributed throughout a number of properties at different geographical locations including, for example, different locations within a city or different cities within a state.

In one embodiment, the progressive gaming system host site computer is maintained for the overall operation and control of the progressive gaming system. In this embodiment, a progressive gaming system host site computer oversees the entire progressive gaming system and is the master for computing all progressive jackpots. All participating gaming sites report to, and receive information from, the progressive gaming system host site computer. Each central server computer is responsible for all data communication between the gaming device hardware and software and the progressive gaming system host site computer. In one embodiment, an individual gaming machine may trigger a progressive award win. In another embodiment, a central server (or the progressive gaming system host site computer) determines when a progressive award win is triggered. In another embodiment, an individual gaming machine and a central controller (or progressive gaming system host site computer) work in conjunction with each other to determine when a progressive win is triggered, for example through an individual gaming machine meeting a predetermined requirement established by the central controller.

In one embodiment, one or more of the progressive awards are each funded via a side bet or side wager. In this embodiment, a player must place or wager a side bet to be eligible to win the progressive award associated with the side bet. In one embodiment, the player must place the maximum bet and the side bet to be eligible to win one of the progressive awards. In another embodiment, if the player places or wagers the required side bet, the player may wager at any credit amount during the primary game (i.e., the player need not place the maximum bet and the side bet to be eligible to win one of the progressive awards). In one such embodiment, the greater the player's wager (in addition to the placed side bet), the greater the odds or probability that the player will win one of the progressive awards.

In another embodiment, one or more of the progressive awards are partially funded via a side-bet or side-wager which the player may make (and which may be tracked via a side-bet meter). In one embodiment, one or more of the progressive awards are funded with only side-bets or side-wagers placed. In another embodiment, one or more of the progressive awards are funded based on player's wagers as described above as well as any side-bets or side-wagers placed.

In one alternative embodiment, a minimum wager level is required for a gaming device to qualify to be selected to obtain one of the progressive awards. In one embodiment, this minimum wager level is the maximum wager level for the primary game in the gaming machine. In another embodiment, no minimum wager level is required for a gaming machine to qualify to be selected to obtain one of the progressive awards.

MULTIPLE BINGO OUTCOMES

In one embodiment, upon a player initiating game play at one of the gaming devices, the gaming device enrolls in an electronic bingo game. In this embodiment, a bingo server electronically "calls" or draws the bingo balls or numbers that result in a specific bingo game outcome. The resultant game outcome is communicated to the individual gaming device to be provided to the player. In one embodiment, the bingo outcome is displayed to the player as a symbol combination in a slot game. In another embodiment, the bingo outcome is displayed to the player as any suitable primary or secondary game outcome in accordance with the present disclosure.

In one embodiment, the bingo server randomly generates bingo balls and/or other bingo numbers or elements based on probability data. In one such embodiment, this random determination is provided through utilization of a random number generator (RNG), such as a true random number generator, a pseudo random number generator, or other suitable randomization process. In one embodiment, each bingo ball or bingo number is associated with a probability and the bingo server generates or draws the bingo ball or bingo number based on the associated probabilities.

In one embodiment, the central server or controller controls and/or adjusts a plurality of bingo outcomes (e.g., a plurality of bingo patterns), a number of bingo balls or numbers, and any probabilities associated with the bingo balls or bingo numbers. In different embodiments, the control and/or adjustment is randomly determined, predetermined, determined based on the player's status (such as determined through a player tracking system), determined based on a random determination by the central controller, determined based on a random determination at the gaming device, determined based on one or more side wagers placed, determined based on the player's primary game wager, determined based on time (such as the time of day), determined by the game operator or gaming establishment or determined based on any other suitable method or criteria.

Figure 3:
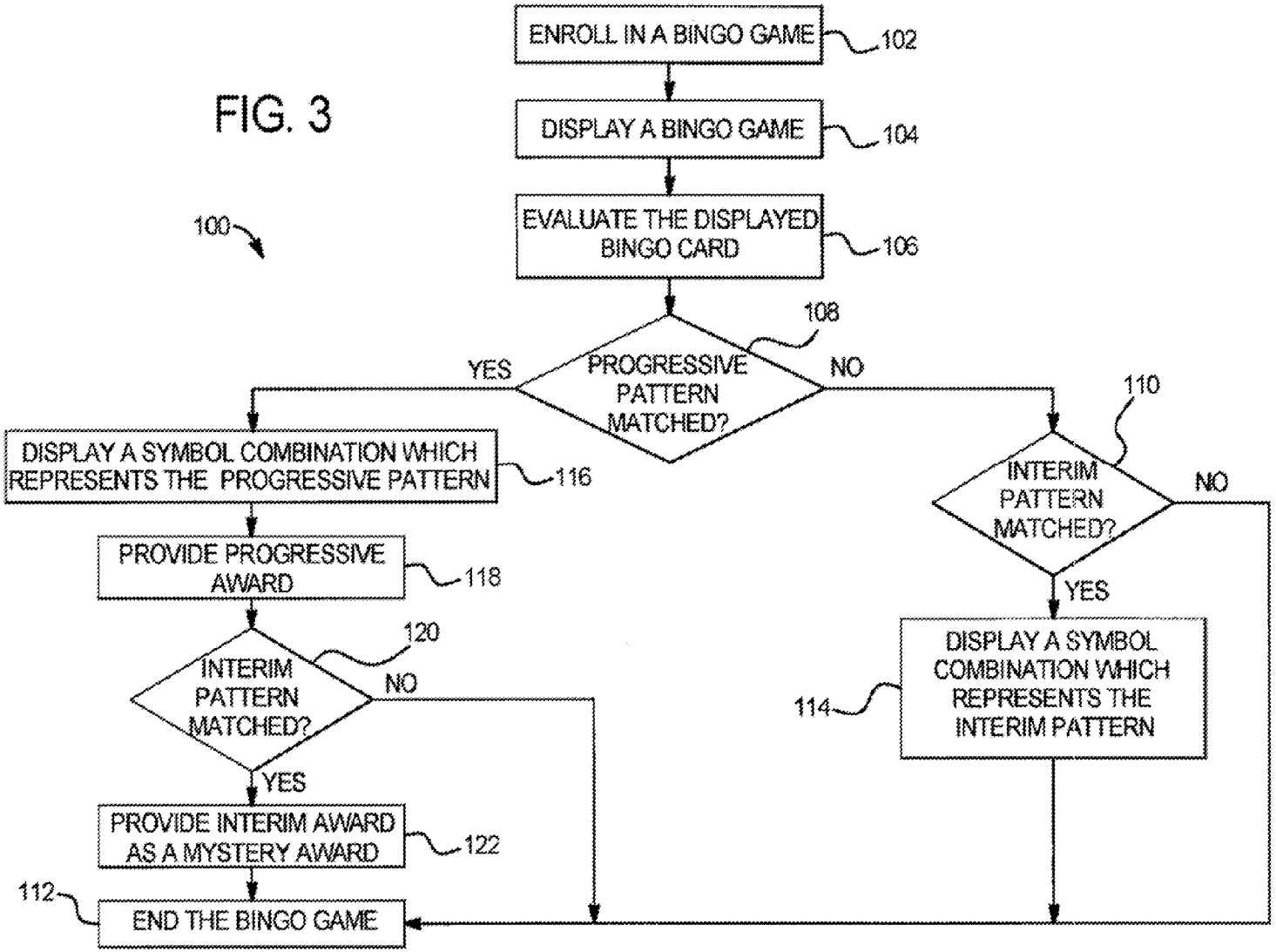
FIG. 3 is a schematic block diagram of one embodiment of the gaming system of the present disclosure.

Referring now to FIG. 3, a flowchart of an example process 100 for providing a bingo game in a gaming system or gaming device is illustrated. In one embodiment, the process 100 is embodied in one or more software programs stored in one or more memories and executed by one or more processors or controllers. Although the process 100 is described with reference to the flowchart illustrated in FIG. 3, it should be appreciated that many other methods of performing the acts associated with process 100 may be used. For example, the order of certain of the blocks may be changed, and certain of the blocks described may be optional.

The process starts at block 102. At block 102, as each gaming device is enrolled in the bingo game, such as upon an appropriate wager or engaging an input device, the enrolled gaming device is provided or associated with a different bingo card. Each bingo card consists of a matrix or array of elements, wherein each element is designated with separate indicia, such as a number. It should be appreciated that each different bingo card includes a different combination of elements. For example, if four bingo cards are provided to four enrolled gaming devices, the same element may be present on all four of the bingo cards while another element may solely be present on one of the bingo cards. In one embodiment, a plurality of the bingo cards are provided to the same enrolled gaming device, wherein the same element may be present on all four of the bingo cards while another element may solely be present on one of the bingo cards.

Upon providing or associating a designated number of different bingo cards with each of a plurality of enrolled gaming devices, at block 104, each of the enrolled gaming devices display the designated number of different bingo cards. In one embodiment, each enrolled gaming device is provided at least one bingo card. In one embodiment, the enrolled gaming device displays each bingo card provided. In another embodiment, the player playing at each enrolled gaming device selects the designated number of different bingo cards for the enrolled gaming device to display. For example, the player places a $1 wager for each of five bingo cards and plays five bingo cards for the same draw as described below.

After providing or associating a different bingo card with each of a plurality of enrolled gaming devices, the central controller or bingo server randomly selects or draws, one at a time, a plurality of the elements. At block 106, each of the displayed bingo cards are evaluated for any game-winning or community patterns marked on one or more of the bingo cards. As each element is selected, a determination is made for each enrolled gaming device as to whether the selected element is present on the bingo card provided to that gaming device. This determination can be made by the central controller, the gaming device, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more game-winning or community patterns are marked on one or more of the provided bingo cards. In one embodiment, the gaming device requires the player to engage a daub button (not shown) to initiate the process of the gaming device marking or flagging any selected elements. It should also be appreciated that as the process of marking or covering selected elements continues until one or more game-winning or community patterns are marked, this embodiment ensures that at least one bingo card will win the bingo game and thus at least one enrolled gaming device will provide a winning bingo game outcome (e.g., a community award) to a player.

Figure 4:
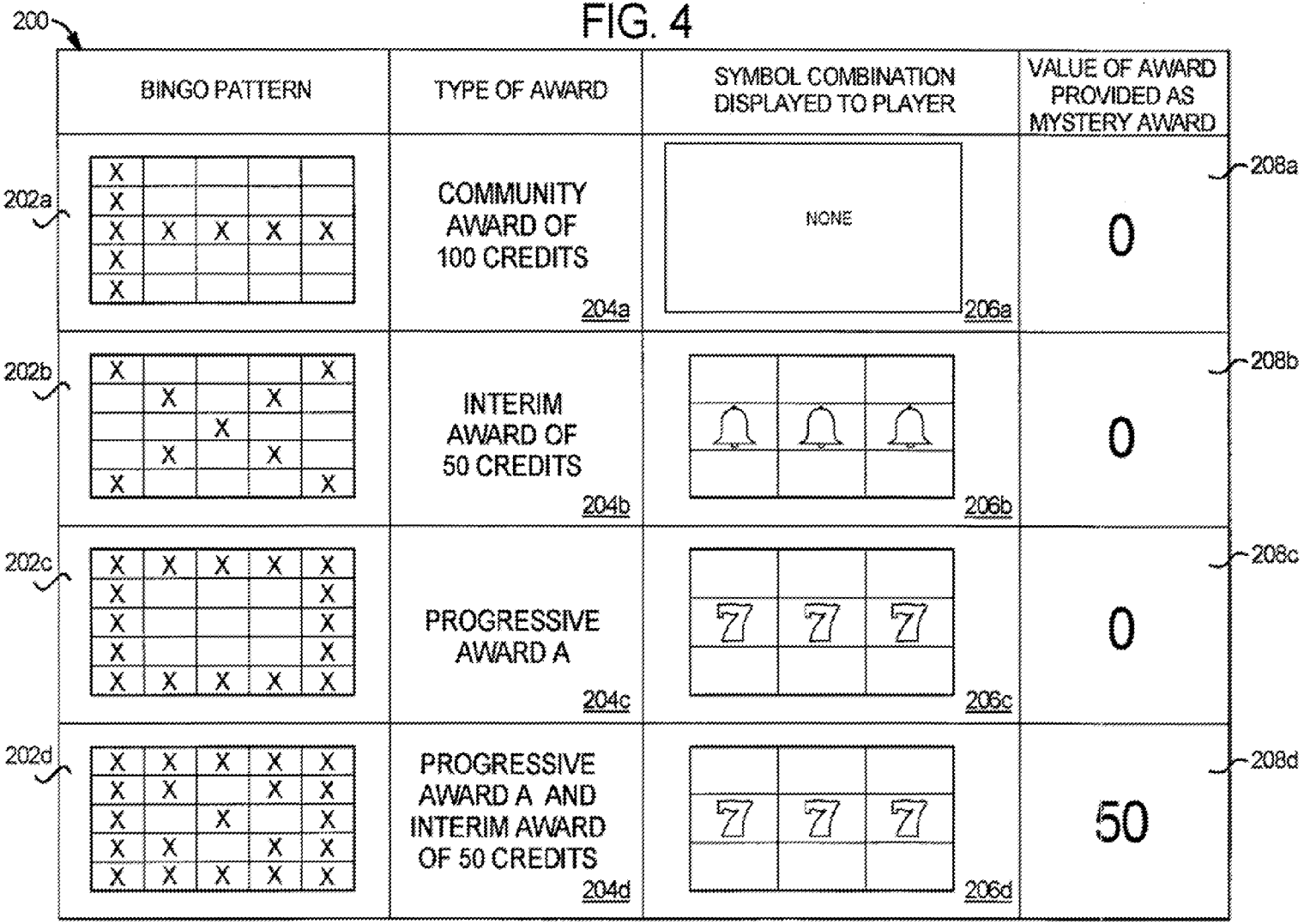
FIG. 4 is an example paytable illustrating a plurality of bingo patterns associated with a plurality of awards or values, wherein each of the awards or values are also associated with at least one symbol combination in accordance with one embodiment of one embodiment of the gaming system of the present disclosure.

Referring now to an example paytable 200 illustrated in FIG. 4, a plurality of bingo patterns 202*a*-202*d* and a plurality of different types of awards 204*a*-204*d* are shown in accordance with one embodiment of the disclosed gaming system and method. Each bingo pattern 202*a*-202*d* is associated with a different type of award 204*a*-204*d*.

One bingo pattern in the example paytable 200 is illustrated as a T-shaped community pattern 202*a*. The community pattern 202*a* is associated with a community award of one-hundred credits. If the community bingo pattern 202*a* is marked on one of the bingo cards provided to one of the enrolled gaming devices, the bingo game ends as described above.

Another bingo pattern of the example paytable 200 is illustrated in FIG. 4 as a square-shaped progressive pattern 202*c*. The progressive pattern 202*c* is associated with a progressive award A. It should be appreciated that one or more of the progressive awards associated with one or more progressive patterns, such as progressive pattern 202*c*, may each be funded or incremented, at least in part, based on the wagers placed on the bingo game (or a primary game associated with the bingo game) of the gaming machines in the gaming system, via a gaming establishment or via any suitable manner. That is, while progressive award A may have an initial value at a first point in time, that value can change or increment to an incremented or accumulated value at a second, subsequent point in time. In one form, a progressive award, such as progressive award A, includes an initial amount funded by a casino and an additional amount funded through a portion of each wager made on the gaming machine. For example, 1% of each wager placed on the bingo game (or a primary game associated with the bingo game) of the gaming machine may be allocated to the progressive award or progressive award fund. The progressive award grows in value as more players play the gaming machine and more portions of the players' wagers are allocated to the progressive award. When the progressive pattern, such as progressive pattern 202*c*, is marked on one of the bingo cards, a winning symbol or symbol combination is displayed that is associated with the accumulated progressive award to be provided to the player. After the progressive award is provided to the player, the amount of the next progressive award is reset to the initial value and a portion of each subsequent wager is allocated to that next progressive award as described above.

In one embodiment, the bingo game outcome may be based on a progressive award in addition to any award provided for winning the bingo game as described above. In this embodiment, if one or more elements are marked or covered in progressive patterns, a progressive award having a value associated with the marked progressive pattern is provided to the player as part of the bingo game outcome. In one embodiment, if the progressive patterns are marked within a designated number of drawn elements, the progressive award associated with the marked progressive pattern is provided to the player as part of the bingo game outcome. For example, if the square-shaped progressive pattern 202*c* is marked on a bingo card within the first twenty selected elements, a progressive award having an initial value of $10,000 is provided to the player as part of the bingo game outcome. It should be appreciated that in this embodiment, the player of a gaming device may be provided a progressive award having at least the initial value (i.e., the progressive increments to a greater value than the initial value) regardless of whether the enrolled gaming device's provided bingo card wins or does not win the bingo game as described above (i.e., whether the game-winning or community pattern is marked or not).

Another bingo pattern in the example paytable 200 is illustrated as an X-shaped interim pattern 202*b*. The interim pattern 202*b* is associated with a static or interim award, such as fifty credits. In one embodiment, the bingo game outcome may be based on a supplemental or interim award in addition to any award provided for winning the bingo game as described above. In this embodiment, if one or more elements are marked or covered in supplemental or interim patterns, a supplemental or interim award or value associated with the marked supplemental pattern is provided to the player as part of the bingo game outcome. In one embodiment, if the supplemental or interim patterns are marked within a designated number of drawn elements, the supplemental or interim award or value associated with the marked supplemental pattern is provided to the player as part of the bingo game outcome. For example, if the X-shaped interim pattern 202*b* is marked on a bingo card within the first twenty selected elements, a supplemental or interim award of 50 credits is provided to the player as part of the bingo game outcome. It should be appreciated that in this embodiment, the player of a gaming device may be provided a supplemental or interim award regardless of whether the enrolled gaming device's provided bingo card wins or does not win the bingo game as described above.

Example paytable 200, as illustrated in FIG. 4, shows the X-shaped interim pattern 202*b* and the square-shaped progressive pattern 202*c* collectively as bingo patterns 202*d*. The bingo patterns 202*d* are associated with a progressive award A and an interim award of fifty credits as illustrated in the example paytable 200.

In one embodiment, the community pattern, the progressive pattern and/or the interim pattern represent different, individual patterns for the same bingo game. In one embodiment, the community pattern, the progressive pattern and/or the interim pattern represent different, individual patterns for the same bingo card. In one embodiment, the community pattern, the progressive pattern and/or the interim pattern are interrelated with one another (e.g., one pattern includes at least one common element with another pattern). In one embodiment, the community pattern, the progressive pattern and/or the interim pattern are not related to one another. For example, the community pattern is associated with the four corners of the bingo card, the interim pattern is associated with an "L" shape and the progressive pattern is associated with an "H" shape. In another embodiment, the community pattern, the interim pattern and/or the progressive pattern each represent different parts of the same bingo pattern. For example, if a bingo pattern has an "X" shape, the interim pattern is associated with a first part of the bingo pattern (e.g., a "/" shape) while the progressive pattern is associated with a second part of the bingo pattern (e.g., a "\" shape).

After one or more game-winning or community patterns are marked on one or more of the bingo cards provided to the enrolled gaming devices, a determination is made whether any additional patterns are marked or covered on one or more of the provided bingo cards. Referring back to FIG. 3, a determination is made at block 108 whether any progressive patterns are marked or covered on one or more of the provided bingo cards. If the determination is that no progressive patterns are marked or covered on the provided bingo cards, a determination is made at block 110 whether any interim patterns are marked or covered on one or more of the provided bingo cards. If the determination is that no interim patterns are marked or covered on the provided bingo cards, the bingo game ends at block 112.

Referring back to FIG. 3, if the determination made at block 110 is that one or more interim patterns are marked or covered on one or more of the provided bingo cards, a game outcome is determined for each of the enrolled gaming devices. For example, at block 114, each gaming device having selected elements marked in an interim pattern is provided a game outcome which corresponds to the value of the static or interim award associated with the interim pattern marked by each of the gaming devices. For example, a first interim pattern (e.g., an X-shaped pattern) is associated with ten credits and a second interim pattern (e.g., an L-shaped pattern) is associated with twenty credits. In this example, if a first gaming device has selected elements marked in a first interim pattern (e.g., an X-shaped pattern), the first gaming device generates and displays a symbol combination which corresponds to ten credits (e.g., the same value as the interim award associated with the first interim pattern). In this example, if a second gaming device has selected elements marked in the second interim pattern (e.g., an L-shaped pattern), the second gaming device generates and displays a symbol combination which corresponds to twenty credits (e.g., the same value as the interim award associated with the second interim pattern). In this example, enrolled gaming devices other than the enrolled gaming device having selected elements marked in the community pattern, generate and display game outcomes or symbol combinations which are not associated with an award. Once the enrolled gaming devices generate and display appropriate game outcomes or symbol combinations, the bingo game ends at block 114.

If the determination made at block 108 is that one or more progressive patterns are marked or covered on the provided bingo cards, each gaming device having a marked progressive pattern displays a bingo game outcome, such as a symbol combination along a plurality of reels in a slot machine game, provided to the player. For example, a first progressive pattern is associated with a progressive award having an initial value of $10,000 and a second progressive pattern is associated with a progressive award having an initial value of $1,000. If a first gaming device has selected elements marked in the first progressive pattern, the first gaming device generates and displays a symbol combination which corresponds to the first progressive award. The generated and displayed symbol combination represents the marked first progressive pattern to the player playing at the first gaming device. If a second gaming device has selected elements marked in the second progressive pattern, the second gaming device generates and displays a symbol combination which corresponds to the second progressive award. The generated and displayed symbol combination represents the marked second progressive pattern to the player playing at the second gaming device. After the game outcomes are generated and displayed by the gaming device(s) having a marked progressive pattern, the progressive award(s) are provided at block 118. It should be appreciated that the progressive award(s) provided at block 118 may be greater than the initial value of the progressive award (s) at a particular point during the play of the bingo game because such progressive award(s) may increment as described above.

A determination is made at block 120 whether any interim patterns are marked or covered on one or more of the provided bingo cards. If the determination is that no interim patterns are marked or covered on the provided bingo cards, the bingo game ends at block 112. On the other hand, if the determination at block 120 is that one or more of the gaming devices having a marked progressive pattern also have a marked interim pattern, a game outcome is determined for each of the gaming devices. The game outcome, such as a symbol combination, corresponds to the same progressive award associated with the progressive pattern. That is, if one of the enrolled gaming devices have both a marked progressive pattern and a marked interim pattern, the progressive award associated with the marked progressive pattern is provided as a symbol-driven progressive award at block 118. Because the symbol combination associated with the progressive award is generated and displayed by the enrolled gaming device, any interim awards associated with the marked interim patterns are provided as mystery awards, such as at block 122. For example, a progressive pattern is associated with a progressive award having an incremented value of $5,142.44 and an interim pattern is associated with an award having an initial value of $100. In this example, if a first gaming device has selected elements marked in the progressive pattern and the interim pattern, the first gaming device generates and displays a symbol combination which corresponds to the first progressive award. The first gaming device provides the interim award of $100 as a mystery award and provides the progressive award having an incremented value of $5,142.44 (e.g., which has an initial value of $5,000 and incremented to the incremented value of $5,142.44) to the player playing at the first gaming device. After providing the progressive award and any interim award(s), the gaming system ends the bingo game at block 112.

In one embodiment, the progressive patterns, and any symbol combinations generated and displayed by the enrolled gaming devices to represent such progressive patterns, are given priority over any other marked pattern (e.g., community patterns or interim patterns). That is, if one of the enrolled gaming devices is provided a bingo card that has selected elements marking a community pattern, one or more interim patterns and a progressive pattern, that gaming device will generate and display a symbol combination that is associated with the progressive award associated with the marked progressive pattern, and provide the community award and any static or interim awards as mystery awards.

In one embodiment, if one of the enrolled gaming devices is provided a bingo card that has selected elements marking a community pattern, that gaming device will neither generate nor display a symbol combination that is associated with the community award associated with the marked community pattern. In an alternative embodiment, the gaming device will generate and display a symbol combination that is associated with the community award associated with the marked community pattern. In one such embodiment, if one of the enrolled gaming devices is provided a bingo card that has selected elements marking a community pattern and a progressive pattern, that gaming device will generate and display a symbol combination that is associated with the progressive award associated with the marked progressive pattern, but will not generate and display a symbol combination that is associated with the community award associated with the marked community pattern.

Referring back to FIG. 4, the example paytable 200 includes a plurality of bingo patterns 202*a*-202*d*. Each bingo pattern 202*a*-202*d* is associated with a different type of award 204*a*-204*d*. A symbol combination 206*a*-206*d* which will be displayed to the player is associated with each different award 204*a*-204*d*. In one embodiment, each symbol combination 206*a*-206*d* is different, such that each different symbol combination 206*a*-206*d* is associated with a different one of the types of awards 204*a*-204*d*. In the embodiment illustrated in FIG. 4, the bingo patterns 202*d* are associated with a symbol combination 206*d* and a mystery award value 208*d*. It should be appreciated that any of the awards 204*a*-204*d* and any of the symbol combinations 206*a*-206*d* could be implemented in a primary game or a bonus game.

If one of the enrolled gaming devices has selected elements marking the community bingo pattern 202*a* and not marking the interim pattern (e.g., bingo pattern 202*b*) or the progressive pattern (e.g., bingo pattern 202*c*), that gaming device will provide the community award to the first player as an award for winning the community bingo game. In the example paytable 200 illustrated in FIG. 4, the gaming device does not generate or display a symbol combination 206*a* associated with the marked community bingo pattern 202*a*. If the community bingo pattern 202*a* is marked on one of the bingo cards provided to one of the enrolled gaming devices, the bingo game indicates that the player of that enrolled gaming device has won the community bingo game (e.g., through any suitable display, such as a message or signage) and the community bingo game ends as described above. If the community bingo pattern 202*a* is marked and neither the interim pattern 202*b* nor the progressive pattern 202*c* are marked, then there is no need to provide a mystery award 208*a*. Therefore, the mystery award 208*a* has a value of zero as illustrated in example paytable 200.

If one of the enrolled gaming devices has selected elements marking the interim pattern 202*b* and not marking the progressive pattern (e.g., bingo pattern 202*c*), that gaming device will generate and display the symbol combination 206*b*, which is illustrated as a symbol combination of BELL-BELL-BELL in example paytable 200. If the interim pattern 202*b* is marked, the symbol combination 206*b* displayed to the player corresponds to the interim pattern 202*b* and there is no need to provide a mystery award 208*b*. Therefore, the mystery award 208*b* has a value of zero as illustrated in example paytable 200.

If one of the enrolled gaming devices has selected elements marking the progressive pattern 202*c* regardless of whether the interim pattern (e.g., bingo pattern 202*b*) is marked, that gaming device will generate and display the symbol combination 206*c*, which is illustrated as a symbol combination of 7-7-7 in example paytable 200. If the progressive pattern 202*c* is marked on one of the bingo cards provided to one of the enrolled gaming devices, the progressive award A is provided to the player playing at the enrolled gaming device associated with the marked progressive pattern 202*c*. If the progressive pattern 202*c* is marked, the symbol combination 206*c* displayed to the player corresponds to the progressive pattern 202*c* and there is no need to provide a mystery award 208*c* since the interim pattern 202*b* was not marked. Therefore, the mystery award 208*c* has a value of zero as illustrated in example paytable 200.

If one of the enrolled gaming devices has selected elements marking the bingo patterns 202*d* (i.e., the interim pattern 202*b* and the progressive pattern 202*c*), that gaming device will generate and display the symbol combination 206*d*, which is illustrated as a symbol combination of 7-7-7 in example paytable 200. It should be appreciated that if the bingo patterns 202*d* are marked (i.e., both the interim pattern 202*b* and the progressive pattern 202*c* are marked), the enrolled gaming device having selected elements marking the bingo patterns 202*d* will generate and display the same symbol combination 206*d* as the symbol combination 206*c* associated with the progressive pattern 202*c*. In this instance, the progressive award A is provided to the player playing at the enrolled gaming device associated with the marked progressive pattern 202*c*. In this instance, the mystery award 208*d* has a value of equal to the value of the static or interim award 204*b* associated with the X-shaped interim pattern 202*b*. As illustrated in example paytable 200, the mystery award 208*d* has a value of fifty credits.

In operation of one embodiment of the gaming system and method disclosed herein, a bingo game is displayed to a plurality of players. Referring now to FIG. 5, the gaming system provides at least one bingo card to each of a plurality of enrolled gaming device 300, 302 and 304, which are being played by players A, B and C, respectively. In the embodiment illustrated in FIG. 5, each gaming device 300, 302 and 304 implements the example paytable 200 to associate a marked bingo pattern with a symbol combination which is displayed to represent the marked bingo pattern. In this embodiment, the symbol combination is displayed in a primary or base game to represent the marked bingo pattern or patterns. In other embodiments, the symbol combination is displayed in a bonus game or a combination of a primary game and a bonus game to represent the marked bingo pattern or patterns.

Figure 6:
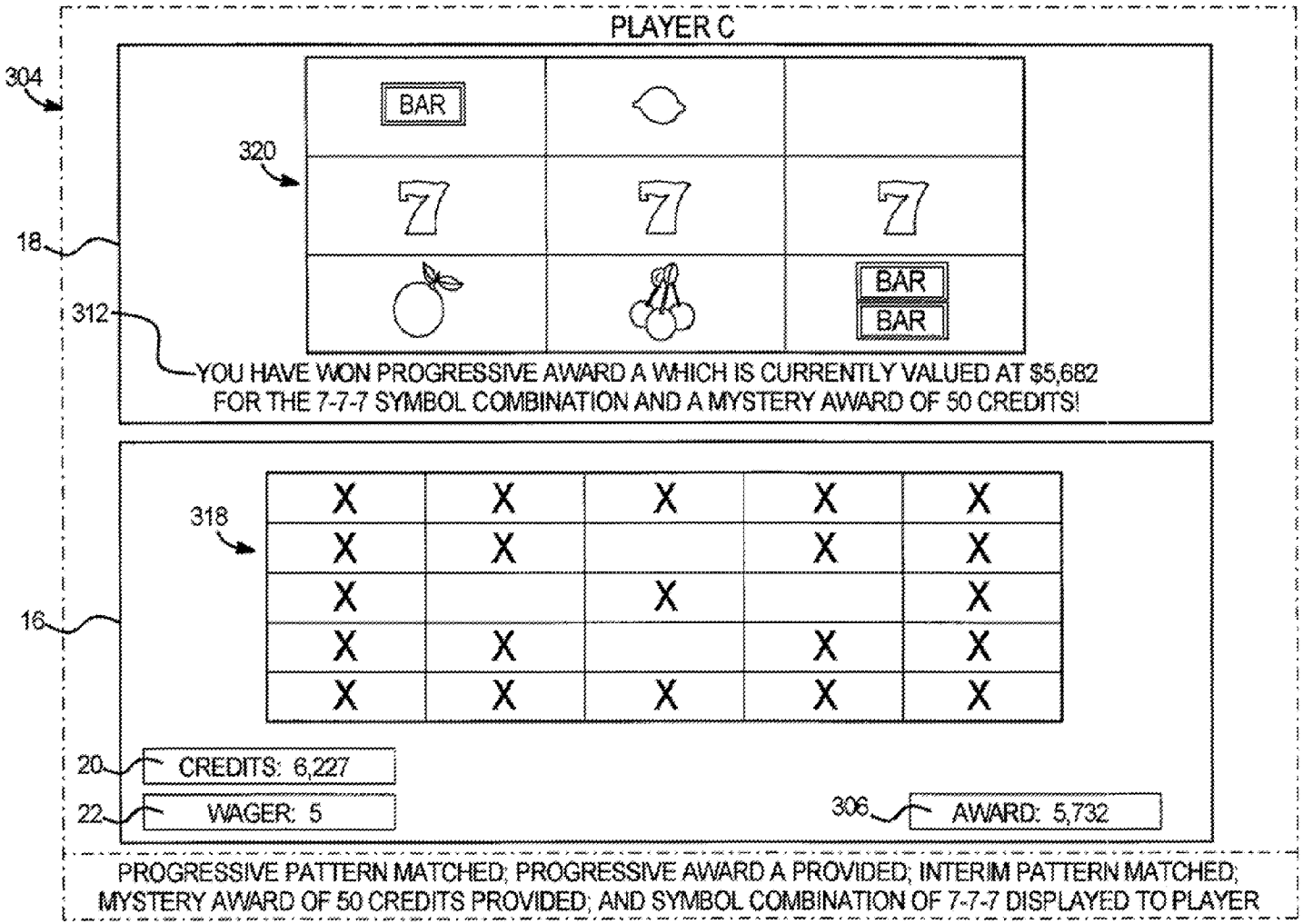
FIG. 6 is an enlarged front plan view of a display device of a gaming device disclosed herein for one of the players, illustrating an example of one embodiment of the present disclosure where a progressive pattern is marked in association with a bingo game displayed to the player.

The enrolled gaming device 300 is being played by Player A in the embodiment illustrated in FIG. 5. Referring now to FIGS. 5 and 6, the display device 16, the display device 18 or both of each enrolled gaming device 300, 302 and 304 illustrate an example of a game play screen for one embodiment of the gaming system described herein. For ease of illustration, the relevant game information is divided between the display devices 16 and 18 such that the bingo game is shown on the display device 16 and the representative symbol combination of the slot game is shown on the display device 18. In alternative embodiments, the relevant game information is divided between different areas of the display device 16 or provided solely by the display device 16. Alternatively, the display device 18 is configured to display the relevant game information.

It should be appreciated that display devices 16 and 18 represent game play screens as viewed by one player at each enrolled gaming device in the gaming system. The following game play screens are configured to be displayed by each enrolled gaming device in the gaming system, with the outcomes of each gaming device being independently controlled by the central controller and/or the gaming device processor based on which elements are marked on the bingo pattern provided to each gaming device.

In the embodiment illustrated in FIG. 5, the display device 16 displays a bingo card provided to the enrolled gaming device 300 being played by Player A for a bingo game. The bingo card shows a bingo pattern 308 provided to the enrolled gaming device 300 being played by Player A. According to the example paytable 200 shown in FIG. 4, the bingo pattern 308 matches a community pattern (e.g., a T-shaped bingo pattern), which is marked or covered by selected elements. The selected elements are illustrated as "x" symbols which mark or cover certain portions of the provided bingo card 308. Since the selected elements mark or cover the community pattern, according to the applicable paytable, the gaming device provides the community award to Player A. That is, though the gaming device displays or generates a losing symbol combination, Player A wins the community bingo game based on the marked community pattern for being the first player who covered the community pattern. Referring back to the example paytable 200 shown in FIG. 4, the marked community pattern is associated with a community award of 100 credits. In this embodiment, Player A wins the community bingo game based on the marked community pattern regardless of any displayed symbols or symbol combinations. In another embodiment, instead of displaying a losing symbol combination in association with the marked community pattern, the gaming device neither displays nor generates a symbol combination corresponding to the marked community pattern.

In the embodiment illustrated in FIG. 5, the display device 18 displays a message or instruction area 312 which can display messages or instructions to the player. The central controller is programmed to control which messages or instructions are displayed by the message area 312. Appropriate messages or instructions such as "CONGRATULATIONS! YOU HAVE WON THE BINGO GAME! YOUR AWARD FOR WINNING THE BINGO GAME IS 100 CREDITS!" OR "CONGRATULATIONS! YOU HAVE WON A PROGRESSIVE AWARD A WHICH IS CURRENTLY VALUED AT $5,682 FOR THE SYMBOL COMBINATION OF . . . !" may be provided to the player visually, or through suitable audio or audiovisual displays.

The display device 16 also displays a credit display 20 which displays Player A's current number of credits, cash, account balance, or the equivalent. The credit display 20 indicates to the player how many credits or other type(s) of currency are available for play of the game. The display device 16 also displays a wager display 22 which displays Player A's amount wagered for each play of the game. The player's amount wagered is a number of the credits and is subtracted from the credit display 20 for each play of the game. As illustrated in FIG. 5, the credit display 20 indicates that Player A has 195 credits. The wager display indicates that the player wagered 5 credits on this play of the bingo game.

The display device 16 also displays an award display 306. The award display 306 indicates to the player how many credits or other type(s) of award are provided in the play of the game. Any award received by a player is added to the award indicated by the award display 306. Once the play of the game ends, the award amount indicated by the award display 306 is provided to the player. The award amount is added to the player's credit total indicated by the credit display 20. As illustrated in FIG. 5, the award display 306 indicates that the player's award is 100 credits because the community pattern is associated with an award of 100 credits. The credit display 20 is incremented by the amount of the award displayed by the award display 306. For example, if Player A started the play with 100 credits, wagered 5 credits, and won an award of 100 credits, the credit display 20 would indicate that Player A has 195 credits after the play ends.

In the embodiment illustrated in FIG. 5, the display device 16 displays a bingo card provided to the enrolled gaming device 302 being played by Player B for a bingo game. The bingo card shows a bingo pattern 308 provided to the enrolled gaming device 302 being played by Player B. According to the example paytable 200 shown in FIG. 4, the bingo pattern 308 matches an interim pattern (e.g., a X-shaped bingo pattern), which is marked or covered by selected elements. The selected elements are illustrated as "x" symbols which mark or cover certain portions of the provided bingo card 308. Since the selected elements mark or cover an interim pattern, according to the applicable paytable, the gaming device displays a symbol combination 316 representing the marked or covered bingo community pattern on the display device 18. According to the example paytable 200 shown in FIG. 4, the interim pattern is associated with an award of 50 credits and a symbol combination of BELL-BELL-BELL.

In the embodiment illustrated in FIG. 5, the display device 18 displays the symbol combination 316 (e.g., BELL-BELL-BELL) which is associated with the marked bingo pattern 308. In one embodiment, the display device 18 also displays a message or instruction area 312 which can display appropriate messages or instructions to the player visually, or through suitable audio or audiovisual displays.

The display device 16 displays the credit display 20 which displays Player B's current number of credits, cash, account balance, or the equivalent. The credit display 20 indicates to the player how many credits or other type(s) of currency are available for play of the game. The display device 16 also displays the wager display 22 which displays Player B's amount wagered for each play of the game. The player's amount wagered is a number of the credits and is subtracted from the credit display 20 for each play of the game. As illustrated in FIG. 5, the credit display 20 indicates that Player B has 395 credits. The wager display indicates that the player wagered 5 credits on this play of the bingo game.

The display device 16 also displays the award display 306. Once the play of the game ends, the award amount indicated by the award display 306 is provided to the player. The award amount is added to the player's credit total indicated by the credit display 20. As illustrated in FIG. 5, the award display 306 indicates that Player B's award is 50 credits because the interim pattern is associated with an award of 50 credits according the example paytable 200 shown in FIG. 4. The credit display 20 is incremented by the amount of the award displayed by the award display 306. For example, if Player B started the play with 350 credits, wagered 5 credits, and won an award of 50 credits, the credit display 20 would indicate that Player B has 395 credits after the play ends.

In the embodiment illustrated in FIGS. 5 and 6, the display device 16 displays a bingo card provided to the enrolled gaming device 304 being played by Player C for a bingo game. The bingo card shows a bingo pattern 308 provided to the enrolled gaming device 304 being played by Player C. According to the example paytable 200 shown in FIG. 4, the bingo pattern 308 matches an interim pattern (e.g., a X-shaped bingo pattern) and a progressive pattern (e.g., a box-shaped bingo pattern), which are marked or covered by selected elements. The selected elements are illustrated as "x" symbols which mark or cover certain portions of the provided bingo card 308. Since the selected elements mark or cover both an interim pattern and a progressive pattern, according to the applicable paytable, the gaming device displays a symbol combination 320 representing the marked or covered progressive pattern on the display device 18. According to the example paytable 200 shown in FIG. 4, the interim pattern is associated with an award of 50 credits which is provided as a mystery award. The progressive pattern is associated with a progressive award having an initial value of $5,000 according to the example paytable 200 shown in FIG. 4. The progressive pattern is associated with a symbol combination of 7-7-7.

In the embodiment illustrated in FIG. 5, the display device 18 displays the symbol combination 320 (e.g., 7-7-7) which is associated with the marked bingo pattern 308. In one embodiment, the display device 18 also displays a message or instruction area 312 which can display appropriate messages or instructions to the player visually, or through suitable audio or audiovisual displays.

The display device 16 displays the credit display 20 which displays Player C's current number of credits, cash, account balance, or the equivalent. The display device 16 also displays the wager display 22 which displays Player C's amount wagered for each play of the game. The player's amount wagered is a number of the credits and is subtracted from the credit display 20 for each play of the game. As illustrated in FIGS. 5 and 6, the credit display 20 indicates that Player B has 6,227 credits. The wager display indicates that the player wagered 5 credits on this play of the bingo game.

The display device 16 also displays the award display 306. Once the play of the game ends, the award amount indicated by the award display 306 is provided to the player. The award amount is added to the player's credit total indicated by the credit display 20. As illustrated in FIGS. 5 and 6, the award display 306 indicates that Player C's award is 5,732 credits (if 1 credit is equal to $1) because the interim pattern is associated with an award of 50 credits according the example paytable 200 shown in FIG. 4 and the progressive pattern is associated with progressive award A, which has a current value of $5,682. The credit display 20 is incremented by the amount of the award displayed by the award display 306. For example, if Player C started the play with 500 credits, wagered 5 credits, and won an award of 5,732 credits, the credit display 20 would indicate that Player B has 6,227 credits after the play ends.

It should be appreciated from FIGS. 5 and 6 that Player C won both the progressive award and the interim award associated with the marked progressive and interim patterns. In this embodiment, the interim award is provided to Player C as a mystery award and the progressive award is provided to Player C as a symbol-driven progressive award which is based on the symbol combination displayed by the display device 18.

In one embodiment, as illustrated in FIG. 7, any marked bingo pattern is associated with a plurality of seeds which each represent a different symbol combination which can be displayed by the display device. In one such embodiment, a table 400 stored by at least one memory device associated with the gaming system includes a plurality of bingo patterns 402. In one embodiment, each of the bingo patterns 402 are associated with the same bingo pattern (e.g., a box-shaped bingo pattern).

In the embodiment illustrated in FIG. 7, each of the bingo patterns is associated with a seed 404. As illustrated, each seed is associated with a progressive award 406, an incidental award or residual award 408 and a symbol combination 410. In operation of this embodiment, once the bingo pattern 402 is marked or covered, the gaming system determines or selects which of the plurality of seeds 404 to associate with the marked or covered bingo pattern. Depending upon which of the plurality of seeds 404 is selected, the gaming system determines which progressive award, incidental or residual award and symbol combination to display.

In the embodiment illustrated in FIG. 7, a first seed is associated with a progressive award A and is not associated with an incidental or residual award. The symbol combination of 7-7-7 is associated with the first seed. A second seed is associated with the same progressive award A, but is also associated with an incidental or residual award of 20 credits. As illustrated, the second seed is associated with a symbol combination including a first symbol combination of 7-7-7 and a second symbol combination of CHERRY-CHERRY-CHERRY. A third seed is associated with the same progressive award A, but is also associated with an incidental or residual award of 50 credits. As illustrated, the third seed is associated with a symbol combination including a first symbol combination of 7-7-7 and a second symbol combination of BELL-BELL-BELL. A fourth seed is associated with the same progressive award A, but is also associated with an incidental or residual award of 100 credits. As illustrated, the fourth seed is associated with a symbol combination including a first symbol combination of 7-7-7 and a second symbol combination of BAR-BAR-BAR.

Although the embodiment illustrated in FIG. 7 is described with respect to a plurality of seeds being associated with the same marked or covered progressive pattern, it should be appreciated that any bingo pattern (e.g., a community pattern, an interim pattern or a progressive pattern) could be associated with a plurality of seeds. In one such embodiment, the seeds associated with the progressive patterns may or may not include incidental or residual awards. In this embodiment, different symbol combinations are associated with the same marked or covered bingo progressive pattern.

In one embodiment wherein a plurality of seeds are associated with a marked or covered bingo pattern, the gaming system randomly determines which of the plurality of seeds to select for the marked or covered bingo pattern. In different embodiments, the gaming system determines which of the seeds to select based on a predetermined criteria, based on the player's status (such as determined through a player tracking system), based on a number of elements selected (i.e., a number of balls or numbers drawn), based on a random determination by the central controller, based on a random determination at the gaming device, based on one or more side wagers placed, based on the player's primary game wager, based on time (such as the time of day), based on a suitable criteria by the game operator or gaming establishment or determined based on any other suitable method or criteria.

In one embodiment, the disclosed gaming system and method includes 1 to n bingo patterns which have substantially the same odds as a progressive outcome on a Class III game. In this embodiment, the 1 to n bingo patterns are also associated with symbol combinations which represent the 1 to n bingo patterns, where n is equal to any designated quantity. That is, in one embodiment, the bingo patterns closely match the probability of the Class III game while being linked to at least one seed (or a plurality of seeds) that determines the symbol combination which is displayed when providing the progressive award associated with the marked or covered bingo pattern. Accordingly, the gaming system and method disclosed herein provides a significant advantage by providing a plurality of ways to map a variety of Class III game outcomes to a common set of bingo patterns.

In another embodiment, the central server or controller receives the bingo game outcome and generates a symbol combination that represents the bingo game outcome for the primary game of a slot game using a look-up table. In another embodiment, the central server or controller randomly generates a symbol combination that represents the bingo game outcome for the secondary game of a slot game. In another embodiment, the central server or controller generates a symbol combination that represents the bingo game outcome for both the primary game and the secondary game of a slot game. In this embodiment, the central server or controller is capable of storing and utilizing program code or other data similar to the processor and memory device of the gaming device.

As described above, in one embodiment, the symbol combination determined by the seed is associated with the progressive award is also associated with a residual or incidental award. For example, when a player plays a bingo game having outcomes displayed on a multi-line slot machine, there is the possibility of awarding incidental or residual awards in addition to the progressive award. In this example, the slot machine displays the symbol combination of 7-7-7 along a first payline to represent the progressive award associated with the progressive pattern and displays a symbol combination of BAR-BAR-BAR along a second, different payline to represent the residual award. Accordingly, the disclosed gaming system and method provides a bingo game wherein when a progressive pattern is marked or covered, the gaming system will award the progressive award and select a seed that produces one of a plurality of different symbol combinations that show the progressive award and any residual awards associated with the marked or covered progressive pattern. Such a configuration enables the gaming system to provide a bingo game with an element of variety in the symbols displayed to the player (for each progressive win) and the total awards provided to the player (for each progressive win). In other words, the gaming system is configured to display different residual awards and different symbol combinations for each of a plurality of different times the same progressive award is won.

In another embodiment, if a progressive pattern is drawn and the drawn progressive pattern is associated with a residual award, the residual award is provided to the player via a secondary game or event. In one such embodiment, in addition to providing the progressive award associated with the drawn progressive pattern, the residual award is provided to the player over a course of a plurality of free spins or free games. In this embodiment, the combination of any non-progressive awards provided to the player (as a result of displayed symbol combinations) for the free games equals the residual award of the drawn progressive pattern. In another such embodiment, in addition to providing the progressive award associated with the drawn progressive pattern, the residual award is provided to the player as a result of a generation of a secondary award device, such as a wheel. In this embodiment, the gaming system provides one or more spins of a wheel having one or more indicators wherein the combination of any non-progressive awards indicated by the active indicators equals the residual award of the drawn progressive pattern.

In another embodiment, a plurality of progressive patterns are each associated with a residual award and a plurality of seeds are also each associated with a residual award. The residual award associated with at least one seed is the same residual award associated with at least one progressive pattern. In this embodiment, when selecting a seed for a drawn progressive pattern, the gaming system attempts to match the residual award amounts for the seed and the progressive pattern. For example, if one of the progressive patterns is associated with a first progressive award and a residual award of five credits, the gaming system selects a seed which is associated with displayed symbol combinations corresponding to the first progressive award and a residual award of five credits. Such a configuration enables the gaming system to display a variety of different symbol combinations with different residual awards when providing the same progressive award to a player (i.e., the gaming system is not obligated to show the same residual award amount and the same symbol combination every time the same progressive award is won).

In another embodiment, when the gaming system determines that a drawn bingo pattern results in the player winning a progressive award, a residual award and an interim award, the gaming system adds the residual award and the interim award. The gaming system then searches for a seed which most closely matches the combined award, but does not exceed the amount of the combined residual award and interim award. For example, if a player hits a bingo pattern to win a first progressive award, a residual award of five credits, and an interim award of seven credits, the gaming system searches for a seed which wins the first progressive award and a residual award of twelve credits (i.e., the five credits for the residual award and the seven credits for the interim award). If the gaming system selects such a seed, the gaming system will utilize that seed to display the appropriate symbol combinations to the player that correspond to the first progressive award and a residual award of twelve credits. On the other hand, if the gaming system does not select such a seed, the gaming system will utilize any seed which produces the first progressive win and a residual award of fewer than twelve credits. In this example, the difference between the utilized seed's residual award and the determined combination of the residual award and interim award is displayed to the player as a mystery award.

In an alternative embodiment, none of the progressive patterns are associated with a residual award. In this embodiment, if a progressive pattern is drawn, the gaming system displays a symbol combination associated with the progressive award of the progressive pattern, wherein none of the other displayed symbols correspond to any symbols or symbol combinations that are associated with a residual award. In another embodiment, the gaming system includes residual awards, but the amount of the residual award won is subtracted from the amount of the progressive award won and the symbol combination displayed to the player reflects this amount.

In another embodiment, rather than constructing a list of progressive patterns and a separate list of interim patterns (as described above), the gaming system constructs and prioritizes a single list which includes progressive patterns (with or without residual awards) and interim patterns. By prioritizing this list and only selecting the highest priority pattern drawn, this embodiment provides that a progressive pattern and interim pattern will not be simultaneously drawn. Accordingly, this embodiment provides that a seed can be selected which displays the symbol combination associated with a progressive award, the symbol combination associated with an interim award or the symbol combinations associated with a progressive award and a residual award.

In one embodiment, at least one progressive pattern is associated with a multi-level progressive award. In one such embodiment, each seed associated with the progressive pattern includes a symbol combination which represents at least one of a plurality of multi-level progressive awards. For example, a progressive pattern is associated with a first seed, a second seed and a third seed. In this example, the first seed is associated with a first level progressive award and a first symbol combination. In this example, the second seed is associated with the first level and second level progressive awards, an incidental award and a second symbol combination. In this example, the third seed is associated with a second level progressive award and a third symbol combination. In one embodiment, one of the seeds associated with the progressive pattern includes a symbol combination for each of a plurality of different progressive awards. In one such embodiment, such different progressive awards may be at the same level or at different levels of the multi-level progressive award.

In one embodiment, a plurality of progressive patterns are associated with a multi-level progressive award. In one such embodiment, each level of the multi-level progressive award includes one or more progressive awards. In one embodiment, a first progressive pattern is associated with at least one first level progressive award, a second progressive pattern is associated with at least one second level progressive award and a third progressive pattern is associated with at least one third level progressive award. In one such embodiment, each progressive pattern is associated with: (i) one of the progressive awards associated with the multi-level progressive award, and (ii) a symbol combination that represents the progressive pattern in a primary game (e.g., a slot game).

It should be appreciated that the gaming system implementer can set the value of the awards associated with each bingo pattern, the quantity of seeds associated with each bingo pattern, and the probability of each bingo pattern of being marked or covered to any suitable values. In one embodiment, such awards or probabilities are randomly determined, predetermined, determined based on the player's status (such as determined through a player tracking system), determined based on a provided bingo pattern, determined based on a number of elements selected (i.e., a number of balls or numbers drawn), determined based on a random determination by the central controller, determined based on a random determination at the gaming device, determined based on one or more side wagers placed, determined based on the player's primary game wager, determined based on time (such as the time of day), determined by the game operator or gaming establishment or determined based on any other suitable method or criteria.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming system comprising:

at least one display device;

at least one input device;

at least one processor; and at least one memory device which stores a plurality of instructions, which when executed by the at least one processor, cause the at least one processor to operate with the at least one display device and the at least one input device to:

(a) receive a wager for a bingo game, the bingo game including at least one bingo card;

(b) determine whether a first designated event occurs in association with the bingo game, the first designated event being associated with a static award;

(c) determine whether a second designated event occurs in association with the bingo game, the second designated event being associated with a progressive award;

(d) when the determination is that only the first designated event occurred in association with the bingo game:

(i) display a first combination of reel symbols which corresponds to the static award, and (ii) provide the static award;

(e) when the determination is that only the second designated event occurred in association with the bingo game:

(i) display a second combination of reel symbols which corresponds to the progressive award, and (ii) provide the progressive award; and (f) when the determination is that the first designated event and the second designated event both occurred in association with the bingo game:

(i) display the second combination of reel symbols which corresponds to the progressive award, (ii) provide the progressive award, and (iii) additionally provide the static award without displaying the first combination of reel symbols which corresponds to the static award.

2. The gaming system of claim 1, wherein the bingo game includes a plurality of elements selected in association with the at least one bingo card.

3. The gaming system of claim 2, wherein the first designated event corresponds to a first bingo pattern being marked by the selected elements on the at least one bingo card.

4. The gaming system of claim 3, wherein the second designated event corresponds to a second, different bingo pattern being marked by the selected elements on the at least one bingo card.

5. The gaming system of claim 1, which includes at least one instruction which stores data representing a plurality of seeds associated with the bingo game, wherein at least a first one of the seeds is associated with a first plurality of combinations of reel symbols including the second combination of reel symbols and a third combination of reel symbols, wherein the third combination of reel symbols is associated with a first non-progressive residual award.

6. The gaming system of claim 5, wherein when executed by the at least one processor, the plurality of instructions cause the at least one processor to select one of the plurality of seeds when the determination is that the second designated event occurred in association with the bingo game.

7. The gaming system of claim 6, wherein when executed by the at least one processor, the plurality of instructions cause the at least one processor to display the third combination of reel symbols and provide the first non-progressive residual award when the first seed is selected.

8. The gaming system of claim 7, wherein at least a second one of the seeds is associated with a second plurality of combinations of reel symbols including the second combination of reel symbols and a fourth combination of reel symbols, wherein the fourth combination of reel symbols is associated with a second non-progressive residual award.

9. The gaming system of claim 8, wherein when executed by the at least one processor, the plurality of instructions cause the at least one processor to display the fourth combination of reel symbols and provide the second non-progressive residual award when the second seed is selected.

10. A gaming system comprising:

at least one display device;

at least one input device;

at least one processor; and at least one memory device which stores a plurality of instructions, which when executed by the at least one processor, cause the at least one processor to operate with the at least one display device and the at least one input device to:

(a) receive a wager for a bingo game, the bingo game including at least one bingo card having a plurality of designated bingo patterns;

(b) determine whether a first one of the bingo patterns is marked in association with the bingo game, the first bingo pattern including an interim pattern that is associated with a static award;

(c) determine whether a second one of the bingo patterns is marked in association with the bingo game, the second bingo pattern including a progressive pattern that is associated with a progressive award; and (d) when the determination is that the interim and progressive patterns are each marked in association with the bingo game:

(i) display a combination of reel symbols which corresponds to the progressive award associated with the progressive pattern, (ii) provide the progressive award, and (iii) provide the static award without displaying a combination of reel symbols which corresponds to the static award associated with the interim pattern.

11. The gaming system of claim 10, wherein the bingo game includes a plurality of elements, the elements being drawn during the bingo game and compared to parts of the at least one bingo card.

12. The gaming system of claim 10, wherein one of the plurality of bingo patterns includes a community pattern which, if marked, causes the at least one processor to terminate the bingo game.

13. The gaming system of claim 10, which includes at least one instruction which stores data representing a plurality of seeds associated with the bingo game, wherein at least a first one of the seeds is associated with a first plurality of combinations of reel symbols including the combination of reel symbols which corresponds to the progressive award and a combination of reel symbols which corresponds to a first non-progressive residual award.

14. The gaming system of claim 13, wherein when executed by the at least one processor, the plurality of instructions cause the at least one processor to select one of the plurality of seeds when the determination is that the progressive pattern is marked in association with the bingo game.

15. The gaming system of claim 14, wherein when executed by the at least one processor, the plurality of instructions cause the at least one processor to display the combination of reel symbols which corresponds to the first non-progressive residual award and provide the first non-progressive residual award if when the first seed is selected.

16. The gaming system of claim 15, wherein at least a second one of the seeds is associated with a second plurality of combinations of reel symbols including the combination of reel symbols which corresponds to the progressive award and a combination of reel symbols which corresponds to a second non-progressive residual award.

17. The gaming system of claim 16, wherein when executed by the at least one processor, the plurality of instructions cause the at least one processor to display the combination of reel symbols which corresponds to the second non-progressive residual award and provide the second non-progressive residual award when the second seed is selected.

18. The gaming system of claim 10, wherein the interim pattern and the progressive pattern represent different, individual patterns on the same bingo card.

* * * * *

UNITED STATES PATENT AND TRADEMARK OFFICE

CERTIFICATE OF CORRECTION

PATENT NO. : 8,500,538 B2
APPLICATION NO. : 12/512561
DATED : August 6, 2013
INVENTOR(S) : Jeremy J. Warner et al.

It is certified that error appears in the above-identified patent and that said Letters Patent is hereby corrected as shown below:

IN THE CLAIMS

In Claim 10, Column 37, Line 6, delete “designated”.
In Claim 15, Column 38, Line 17, delete “if”.

Signed and Sealed this
Seventeenth Day of December, 2013

Margaret A. Focarino

Margaret A. Focarino
*Commissioner for Patents of the United States Patent and Trademark Office*

UNITED STATES PATENT AND TRADEMARK OFFICE

CERTIFICATE OF CORRECTION

PATENT NO. : 8,500,538 B2
APPLICATION NO. : 12/512561
DATED : August 6, 2013
INVENTOR(S) : Warner et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 672 days.

Signed and Sealed this
Seventeenth Day of February, 2015

Michelle K. Lee

Michelle K. Lee
*Deputy Director of the United States Patent and Trademark Office*